US009278775B2

(12) United States Patent
Meers et al.

(10) Patent No.: US 9,278,775 B2
(45) Date of Patent: Mar. 8, 2016

(54) CRATE WITH COLLAPSIBLE WALL

(75) Inventors: Ryan C. Meers, Los Angeles, CA (US); Justin M. Smyers, San Luis Obispo, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 2507 days.

(21) Appl. No.: 11/694,332

(22) Filed: Mar. 30, 2007

(65) Prior Publication Data

US 2008/0142530 A1 Jun. 19, 2008

Related U.S. Application Data

(60) Provisional application No. 60/869,903, filed on Dec. 13, 2006.

(51) Int. Cl.

| | |
|---|---|
| ***B65D 6/00*** | (2006.01) |
| ***B65D 8/14*** | (2006.01) |
| ***B65D 19/00*** | (2006.01) |
| ***B65D 25/54*** | (2006.01) |
| ***B65D 6/18*** | (2006.01) |
| ***B65D 21/02*** | (2006.01) |
| ***B65D 21/06*** | (2006.01) |
| ***B65D 25/00*** | (2006.01) |

(52) U.S. Cl.

CPC ..... *B65D 11/184* (2013.01); *B65D 21/0212* (2013.01); *B65D 21/062* (2013.01); *B65D 25/005* (2013.01)

(58) Field of Classification Search

CPC ..... B65D 11/184; B65D 21/0212; B65D 21/062; B65D 25/005

USPC ..... 220/6, 660, 666; 206/774, 600

See application file for complete search history.

(56) References Cited

U.S. PATENT DOCUMENTS

| | | | | |
|---|---|---|---|---|
| 3,360,180 | A * | 12/1967 | Venturi | 220/7 |
| 3,835,792 | A | 9/1974 | Wharton | |
| 3,981,410 | A | 9/1976 | Schurch | |
| 4,406,380 | A | 9/1983 | Paige | |
| 4,674,647 | A | 6/1987 | Gyenge | |

(Continued)

FOREIGN PATENT DOCUMENTS

| | | |
|---|---|---|
| CH | 456 438 | 7/1968 |
| DE | 92 03 114 | 5/1992 |

(Continued)

OTHER PUBLICATIONS

European Search Report for European Application No. 07254779.7, Apr. 11, 2008.

(Continued)

*Primary Examiner* — Fenn Mathew
*Assistant Examiner* — Andrew T Kirsch
(74) *Attorney, Agent, or Firm* — Carlson, Gaskey & Olds P.C.

(57) ABSTRACT

A crate, such as for transporting egg cartons or other items, includes a base, opposed side walls and a rear wall extending upward from the base. A front wall opposite the rear wall is selectably moveable between a closed position and a retracted, open position. In the retracted position, access to the interior of the crate is provided. In one embodiment, the front wall includes a plurality of pivotably connected sections, such that the front wall can be retracted to provide access to the interior.

14 Claims, 27 Drawing Sheets

(56) References Cited

U.S. PATENT DOCUMENTS

| | | | | |
|---|---|---|---|---|
| 4,765,480 | A | 8/1988 | Malmanger | |
| 5,016,772 | A | 5/1991 | Wilk | |
| 5,161,709 | A | 11/1992 | Oestreich, Jr. | |
| 5,562,224 | A * | 10/1996 | Pascal et al. | 220/4.33 |
| 5,660,291 | A * | 8/1997 | Dash | 220/6 |
| 6,015,056 | A | 1/2000 | Overholt et al. | |
| 6,056,177 | A * | 5/2000 | Schneider | 224/401 |
| 6,098,827 | A | 8/2000 | Overholt et al. | |
| 6,209,742 | B1 | 4/2001 | Overholt et al. | |
| 6,290,081 | B1 | 9/2001 | Merey | |
| 6,305,566 | B1 | 10/2001 | Pigott | |
| 6,601,724 | B1 | 8/2003 | Koefelda | |
| 6,691,885 | B2 * | 2/2004 | Brown | 220/7 |
| 6,918,502 | B1 | 7/2005 | Overholt et al. | |
| 7,011,225 | B2 | 3/2006 | Oster et al. | |
| 7,264,122 | B2 | 9/2007 | Koefelda et al. | |
| 2002/0070215 | A1 | 6/2002 | Walsh et al. | |
| 2003/0000950 | A1 | 1/2003 | Murakami et al. | |
| 2004/0200833 | A1 | 10/2004 | Dubois et al. | |
| 2006/0231555 | A1 | 10/2006 | Smyers et al. | |
| 2006/0260976 | A1 | 11/2006 | Apps | |

FOREIGN PATENT DOCUMENTS

| | | |
|---|---|---|
| DE | 93 05 904 | 8/1993 |
| EP | 0690003 | 1/1996 |
| EP | 0 785 142 | 7/1997 |
| EP | 1 225 131 | 7/2002 |
| FR | 1227059 | 6/1959 |
| GB | 2 357 078 | 6/2001 |
| GB | 2357078 | 6/2001 |
| GB | 2 360 762 | 10/2001 |
| GB | 2360762 | 10/2001 |
| GB | 2 431 922 | 5/2007 |
| GB | 2 449 502 | 11/2008 |
| JP | 2007-76655 | 3/2007 |
| WO | 95/21773 | 8/1995 |
| WO | 98/40199 | 9/1998 |
| WO | 2006/010311 | 2/2006 |

OTHER PUBLICATIONS

European Search Report for EP Application No. 08252850.6, Dec. 16, 2008.

European Search Report Dated Feb. 28, 2011.

* cited by examiner

CRATE WITH COLLAPSIBLE WALL

The application claims priority to U.S. Provisional Application No. 60/869,903, which was filed on Dec. 13, 2006.

BACKGROUND OF THE INVENTION

The present invention relates generally to containers and more particularly to a crate that is particularly useful for transporting egg cartons or other items to a store.

Currently, egg cartons are shipped to stores in metal crates. The crates must be unloaded onto shelves for the customers to select and purchase. This requires labor for handling the egg cartons in the store. The metal crates are expensive and are damaged easily. They are also subject to rust and are not recyclable. They are also not easily repairable.

SUMMARY OF THE INVENTION

The present invention provides a crate or container, such as for transporting egg cartons or other items. The crate includes a base, opposed side walls and a rear wall extending upward from the base. A front wall opposite the rear wall is selectably moveable between a closed position and a retracted, open position. In the retracted position, access to the interior of the crate is provided.

In use, egg cartons (or other items) would be shipped to a store in the crate with the front wall closed. At the store, the front wall would be retracted to provide access to the egg cartons in the interior of the crate by customers or by store workers. The empty crate can then be returned to be reused in shipping additional egg cartons.

These and other features of the present invention can be best understood from the following specification and drawings, the following of which is a brief description.

DETAILED DESCRIPTION OF THE PREFERRED EMBODIMENT

Figure 1:
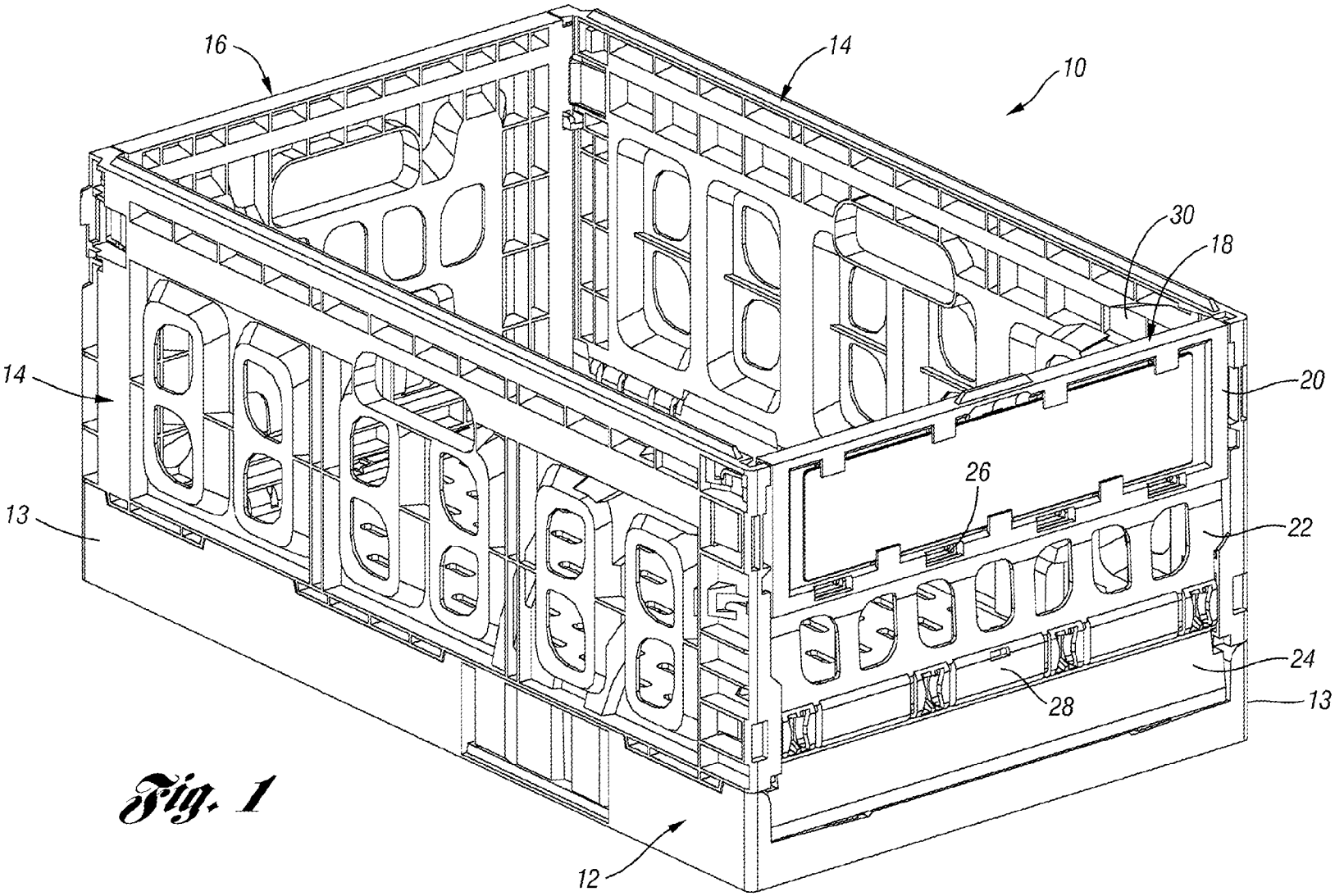
FIG. 1 is a perspective view of a crate according to a first embodiment of the present invention.

A crate 10, such as for transporting egg cartons or other items, according to a first embodiment of the present invention is shown in FIG. 1. The crate 10 includes a base 12 having integrally molded upstanding portions 13 to which are hingably connected side walls 14. A rear wall 16 is also hingably connected to the base 12 and latched to the side walls 14. The front wall 18 includes an upper section 20, a middle section 22 and a lower section 24. The upper section 20 is connected to the middle section 22 by a hinge 26. The middle section 22 is connected to the lower section 24 by a hinge 28.

The interior of the side walls 14 each include a curved channel 30 extending from an upper portion of the upper section 20 down to the base 12 in an arcuate path.

Figure 2:
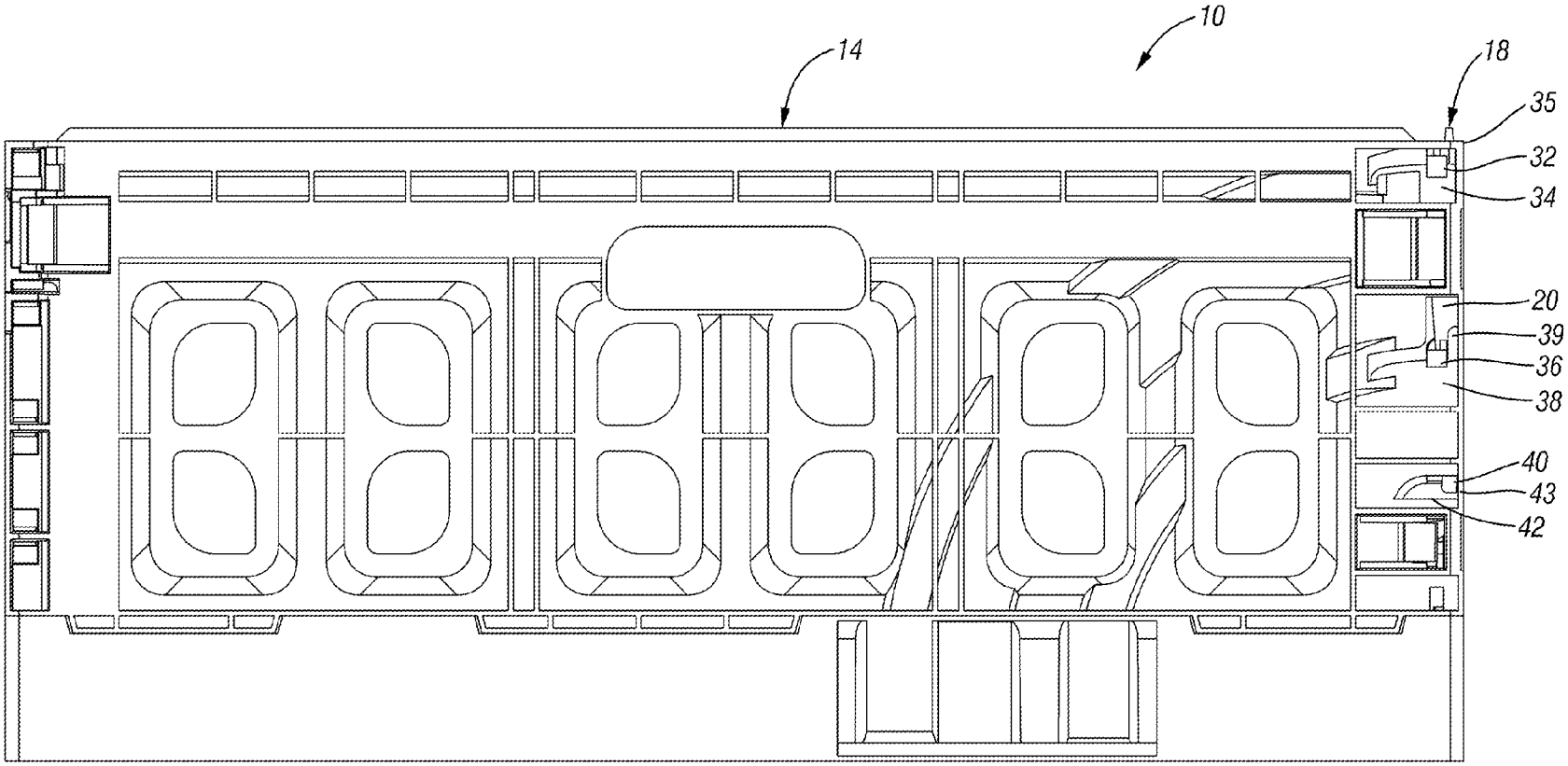
FIG. 2 is a side view of the crate of FIG. 1.

FIG. 2 is a side view of the crate 10. The front wall is hooked to the side wall 14 in several locations. The upper section 20 includes a pair of hooks or downwardly extending tabs 32, 36 that interlock with rails 34, 38, respectively, on the side wall 14. The lower section 24 (not visible in FIG. 2) includes a hook or downwardly extending tab 40 that interlocks with a rail 42 on the side wall 14. Generally, the tabs 32, 36, 40 engage the rails 34, 38, 42 as the front wall 18 is pivoted from a collapsed position on the base to the upright position as shown in FIG. 2. The features on the side wall 14 prevent the front wall 18 from rotating outwardly of the upright position. For example, the tabs 32, 36, 40 abut stops 35, 39, 43 adjacent the rails 34, 38, 42, respectively, thereby preventing the front wall 18 from rotating outwardly of the upright position. The stop 39 is an upwardly extending leg from the rail 38, such that the tab 36 can be lifted over the stop 39, as will be explained later.

Figure 3:
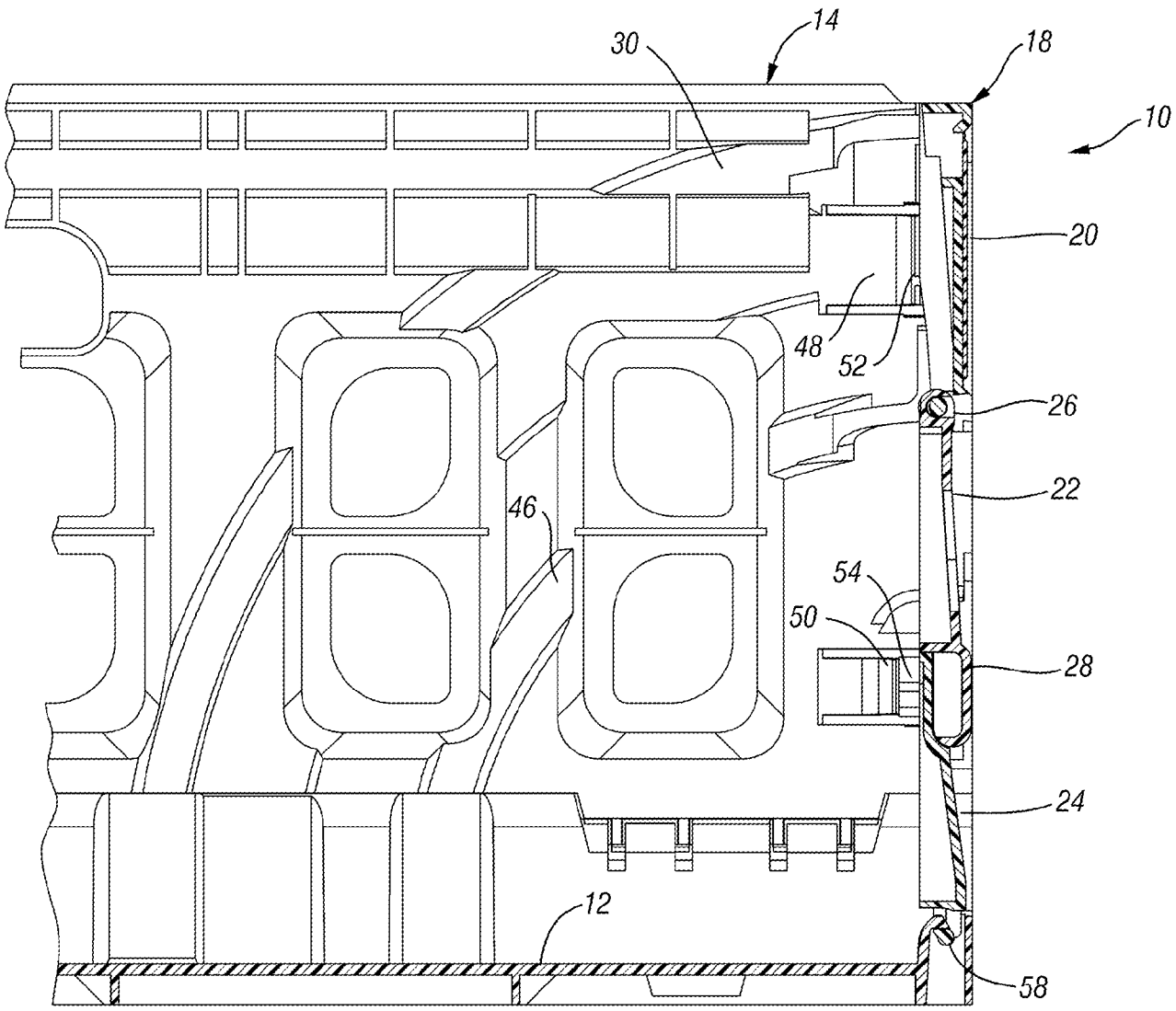
FIG. 3 is a section view of the crate of FIG. 1.

FIG. 3 is a section view through the front wall 18 of FIG. 2. It should be noted that FIG. 3 illustrates the interior surface of the opposite side wall 14, as compared to FIG. 2 which illustrates the exterior surface of the other side wall 14; however, the two side walls 14 are mirror image parts. To prevent the front wall 18 pivoting inwardly, the side wall 14 includes a pair of cantilevered flexible latches 48, 50 engaging complementary latch members 52, 54 on the front wall 18.

The curved channel 30 on the interior surface of the side wall 14 is generally aligned to accommodate the tab 32 (FIG. 2) on the upper section 20 of the front wall 18 as the front wall 18 is pivoted onto the base 12. A second curved channel 46 is likewise aligned with the tab 36 of the front wall 18. The front wall 18 can be collapsed onto the base 12 when the latches 48, 50 are released, or by the sufficient application of force to overcome the latches 48, 50.

As shown, the lower section 24 of the front wall 18 is pivotally connected to the base 12 by a hinge 58.

Figure 4:
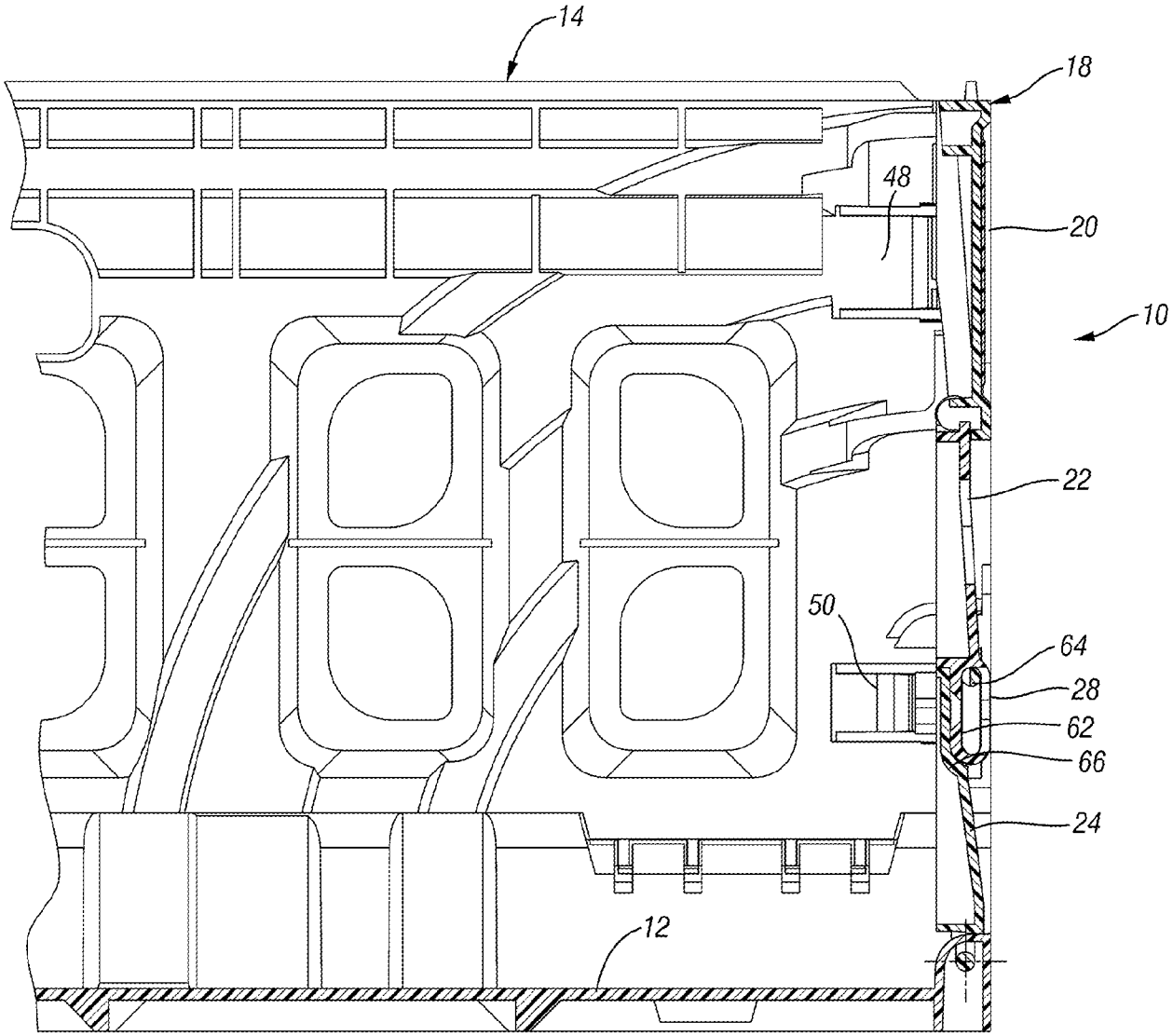
FIG. 4 is a section view of the crate of FIG. 1.
Figure 5:
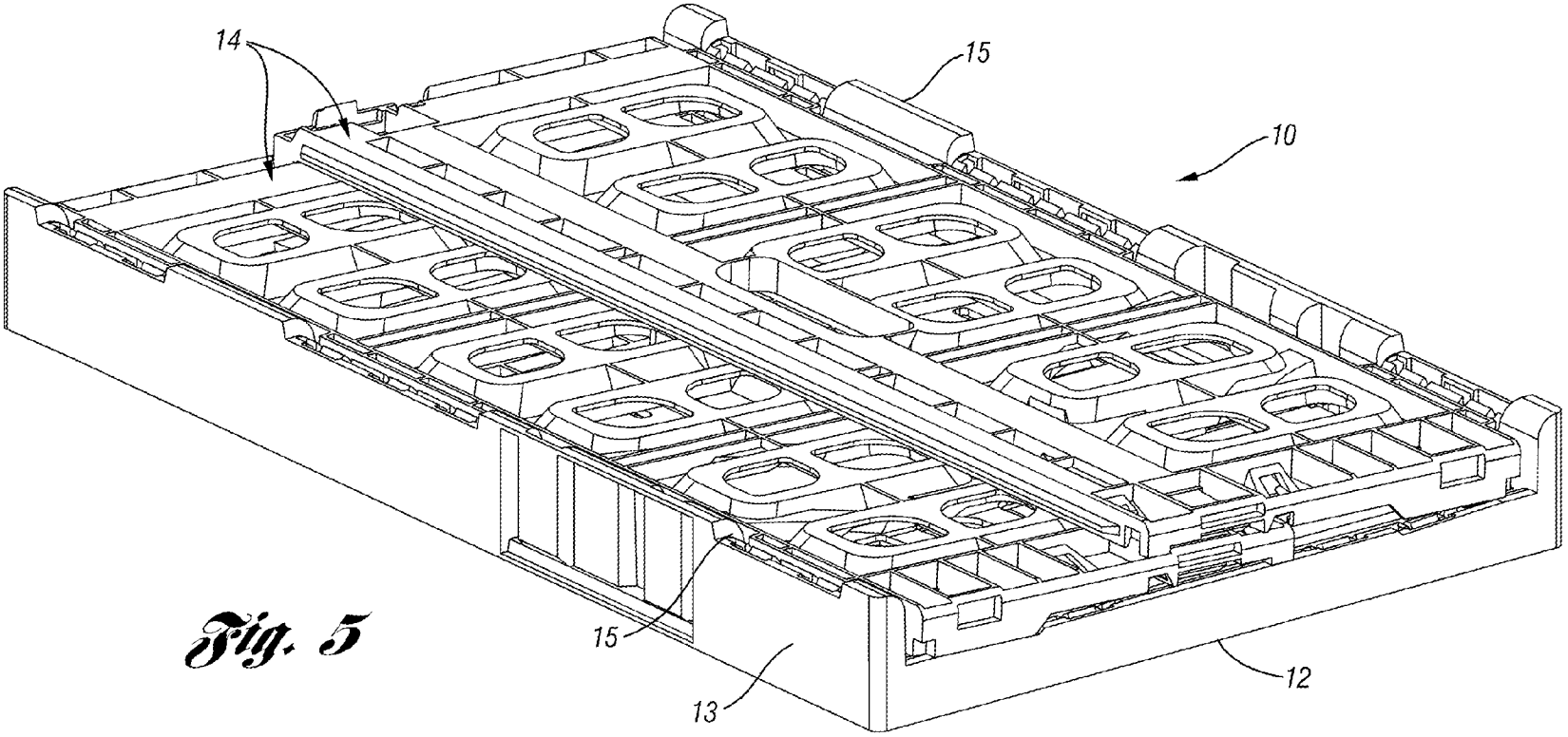
FIG. 5 is a perspective view of the crate of FIG. 1 in a collapsed position.

FIG. 4 is another section view through the front wall 18 showing the hinge 28 in more detail. The hinge 28 connects the middle section 22 to the lower section 24 such that the middle section 22 is slidable and pivotable relative to the lower section 24. The middle section 22 is not pivotable relative to the lower section 24 when slid to the position as shown in FIG. 4. The hinge 28 includes an elongated hinge receiver 62 integrally molded with the middle section 22. A hinge pin 64, integrally molded with the lower section 24, is received in the hinge receiver 62. The hinge pin 64 is slidable within the elongated hinge receiver 62. In the position shown in FIG. 4, the hinge receiver 62 is received in a recess 66 formed in the lower section 24, which prevents rotation of the hinge receiver 62 about the hinge pin 64. In this position, the middle section 22 and lower section 24 are essentially a single rigid member such that the front wall 18 can be knocked down by exerting force on the outside of the front wall 18 and overcoming the latches 48, 50 to collapse the front wall 18 onto the base 12. The rear wall 16 (FIG. 1) and side walls 14 can then be collapsed as well. The fully collapsed container 10 is shown in FIG. 5. The side walls 14 are collapsed over the rear wall 16 and front wall 18 and one of the side walls 14 partially overlaps the other.

Figure 6:
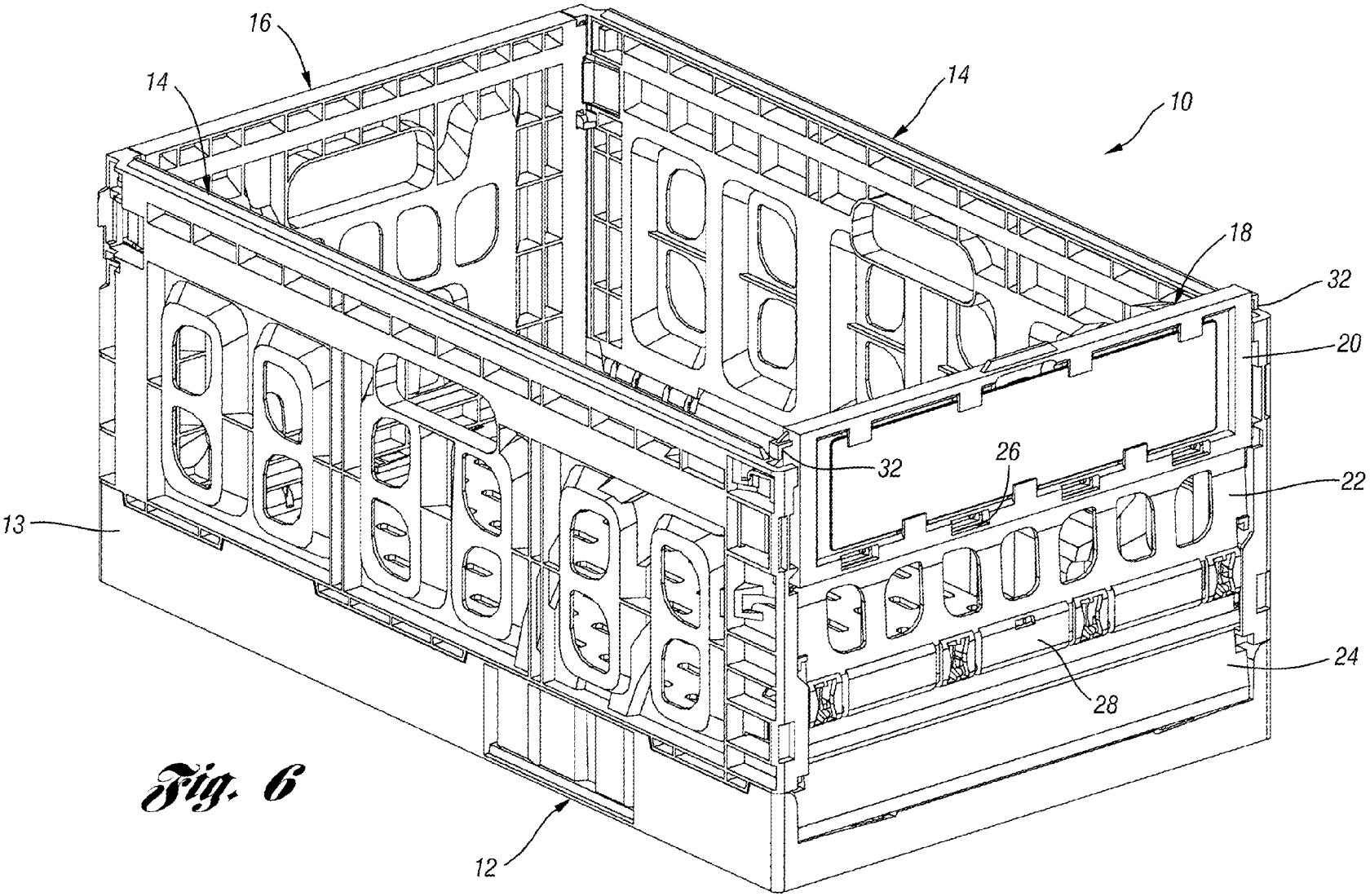
FIG. 6 shows the crate of FIG. 1 showing the first step for retracting the front wall.
Figure 7:
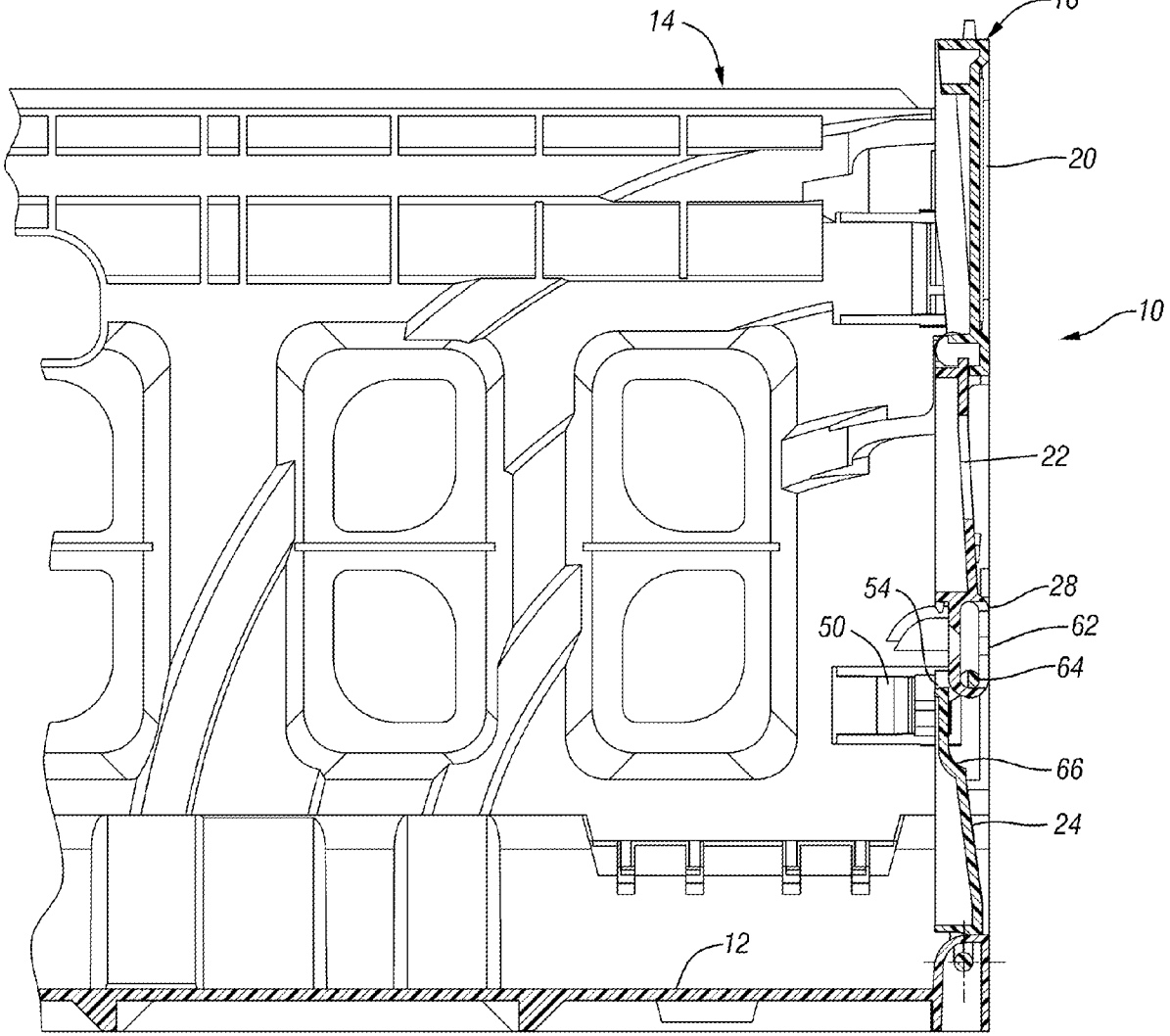
FIG. 7 is a section view of the crate of FIG. 6.

The front wall 18 can also be retracted as shown in FIGS. 6-11. Referring to FIG. 6, the user first pulls up on the upper section 20, which lifts the upper section 20 and middle section 22, but not the lower section 24. This also raises the tabs 32, 36 (FIG. 2) such that they are no longer engaged with the rails 34, 38 (FIG. 2). Referring to FIG. 7, the middle section 22 moves upwardly relative to the lower section 24. The hinge pin 64 is slid to the bottom of the hinge receiver 62, such that the hinge receiver 62 is no longer received within the recess 66 of the lower section 24. In this position, the hinge 28 is free to rotate, such that the middle section 22 can be pivoted relative to the lower section 24. The lower section 24 is still locked relative to the base 12 and side wall 14.

Figure 8:
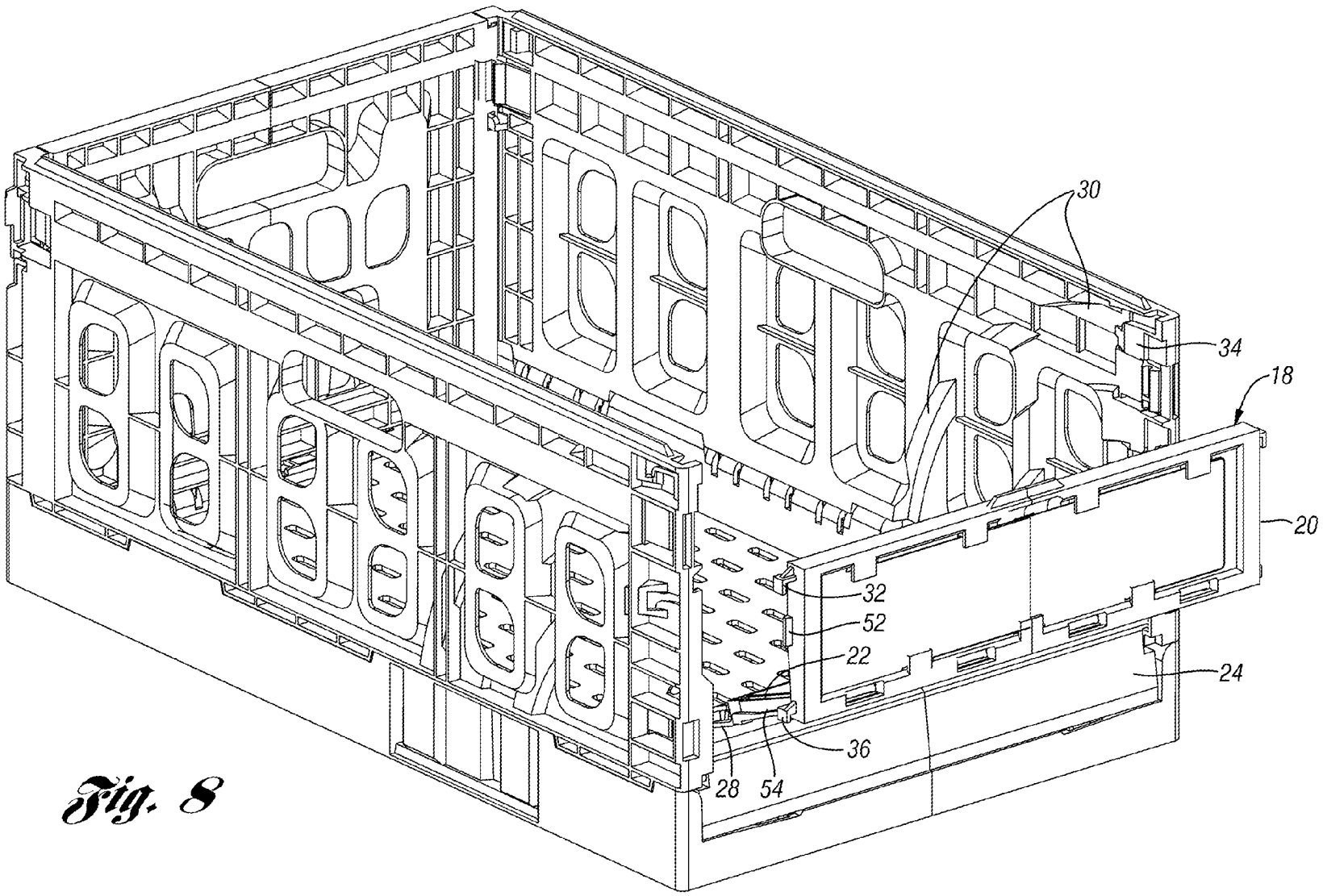
FIG. 8 illustrates a second step for retracting the front wall.
Figure 9:
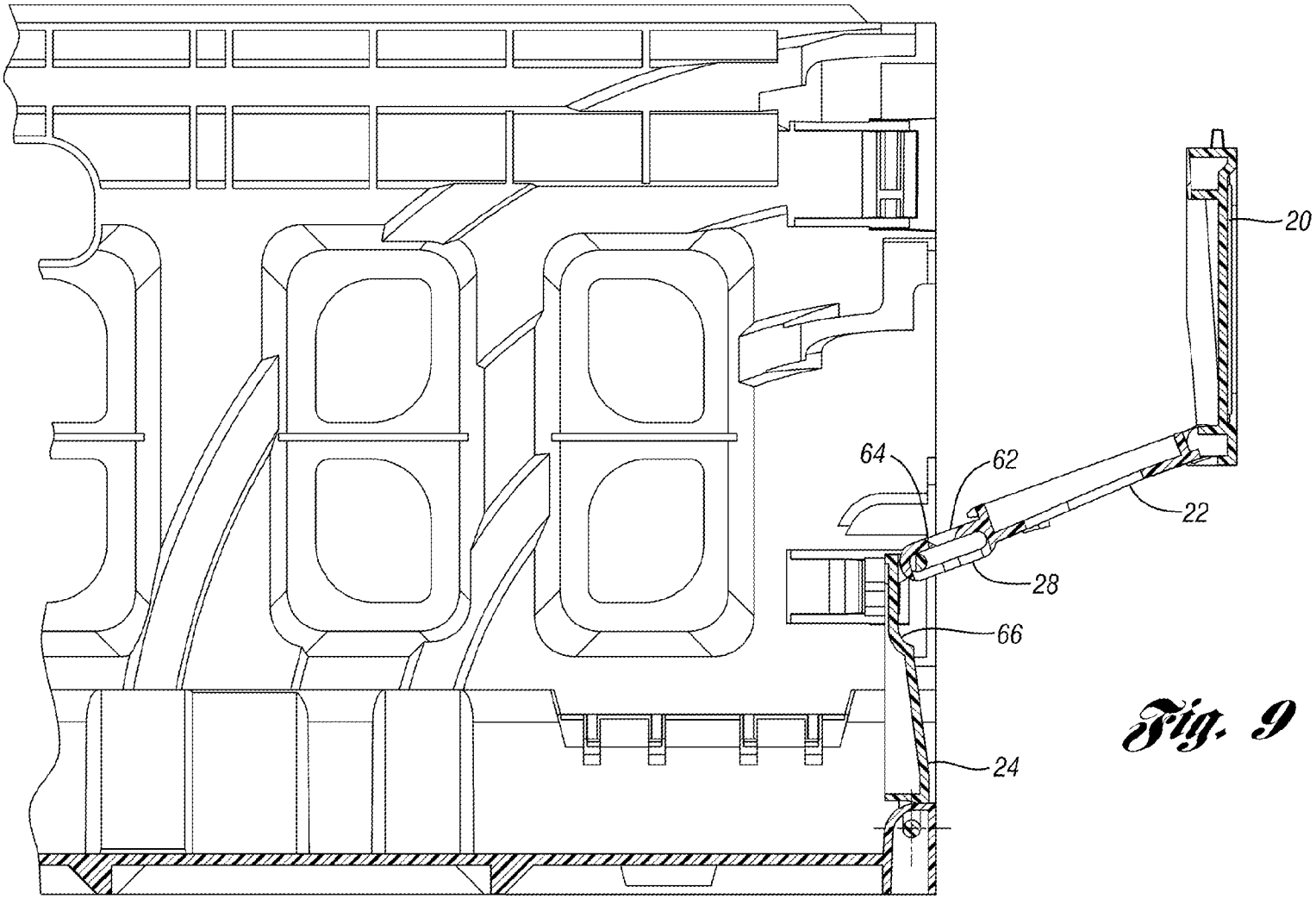
FIG. 9 is a section view of the crate of FIG. 8.
Figure 10:
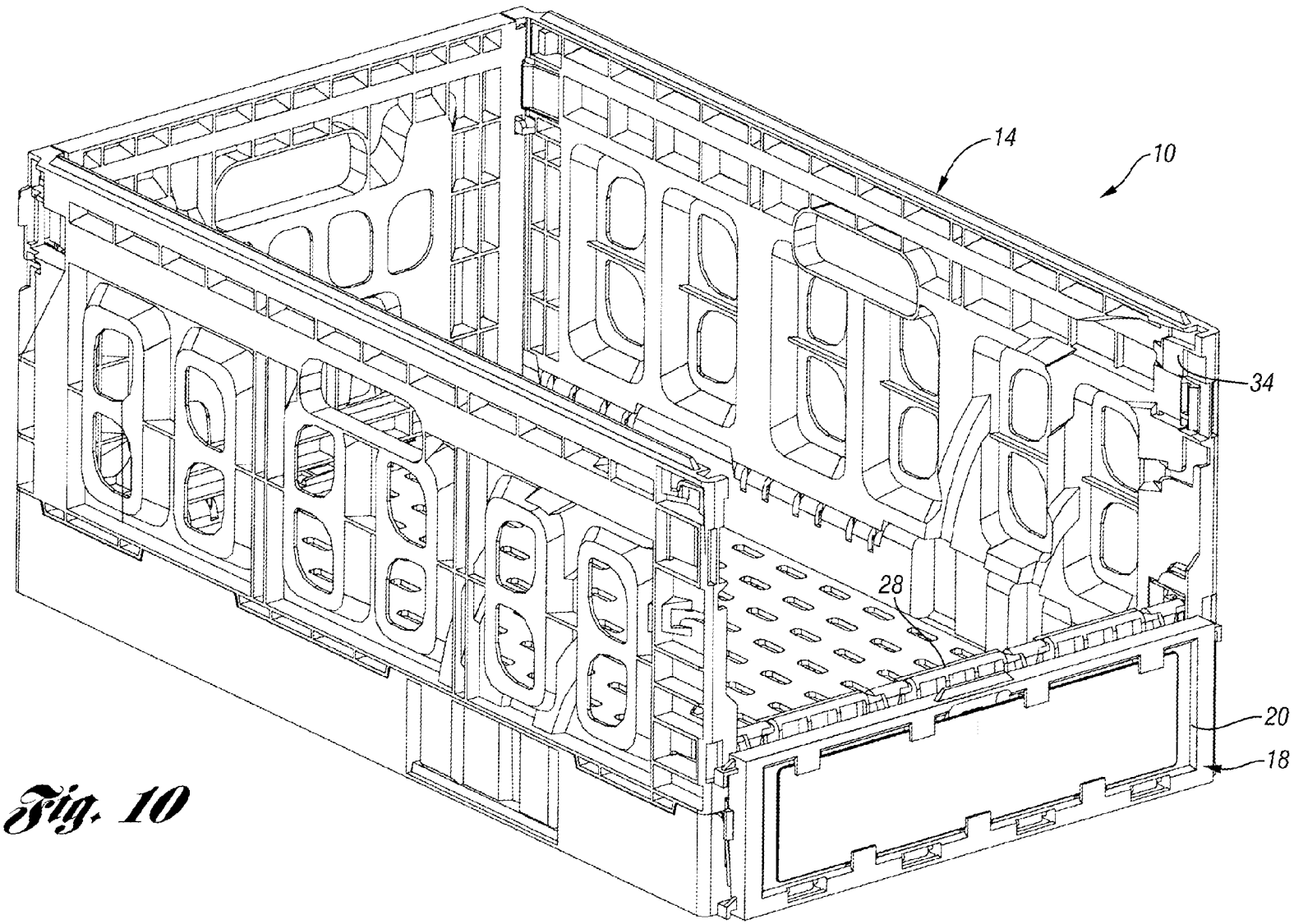
FIG. 10 illustrates a third step in collapsing the front wall.
Figure 11:
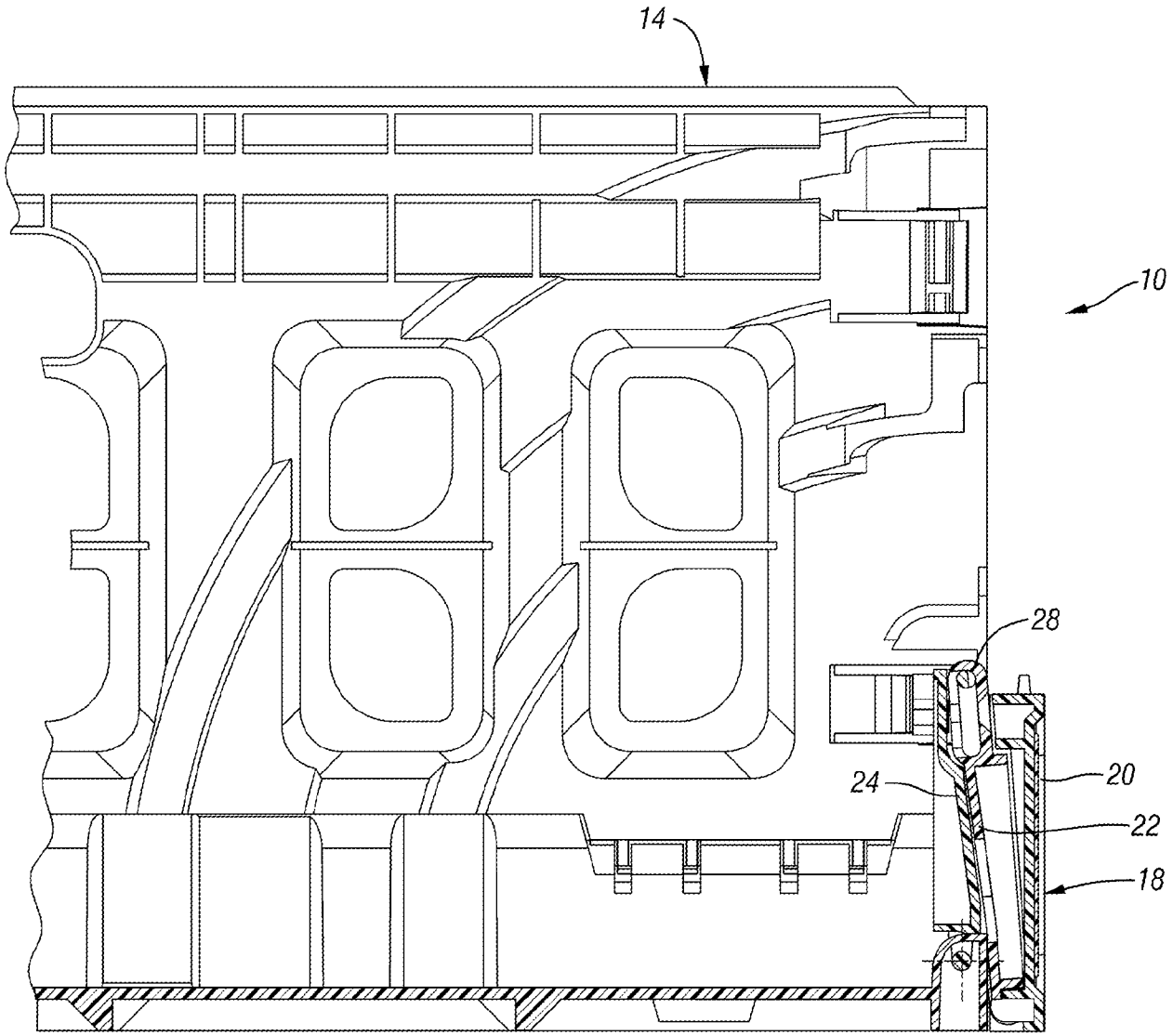
FIG. 11 is a section view of the crate of FIG. 10.

FIG. 8 illustrates a second step in retracting the front wall 18. The upper section 20 and the middle section 22 are pivoted outwardly and downwardly as shown. Referring to FIG. 9, the middle section 22 pivots about the hinge 28 relative to the lower section 24. FIGS. 10 and 11 illustrate a third step in retracting the front wall 18 in which the middle section 22 abuts the lower section 24, while the upper section 20 abuts the middle section 22. With the front wall 18 in the retracted position, easy access to the interior of the crate 10 is provided above the retracted front wall 18.

Figure 12:
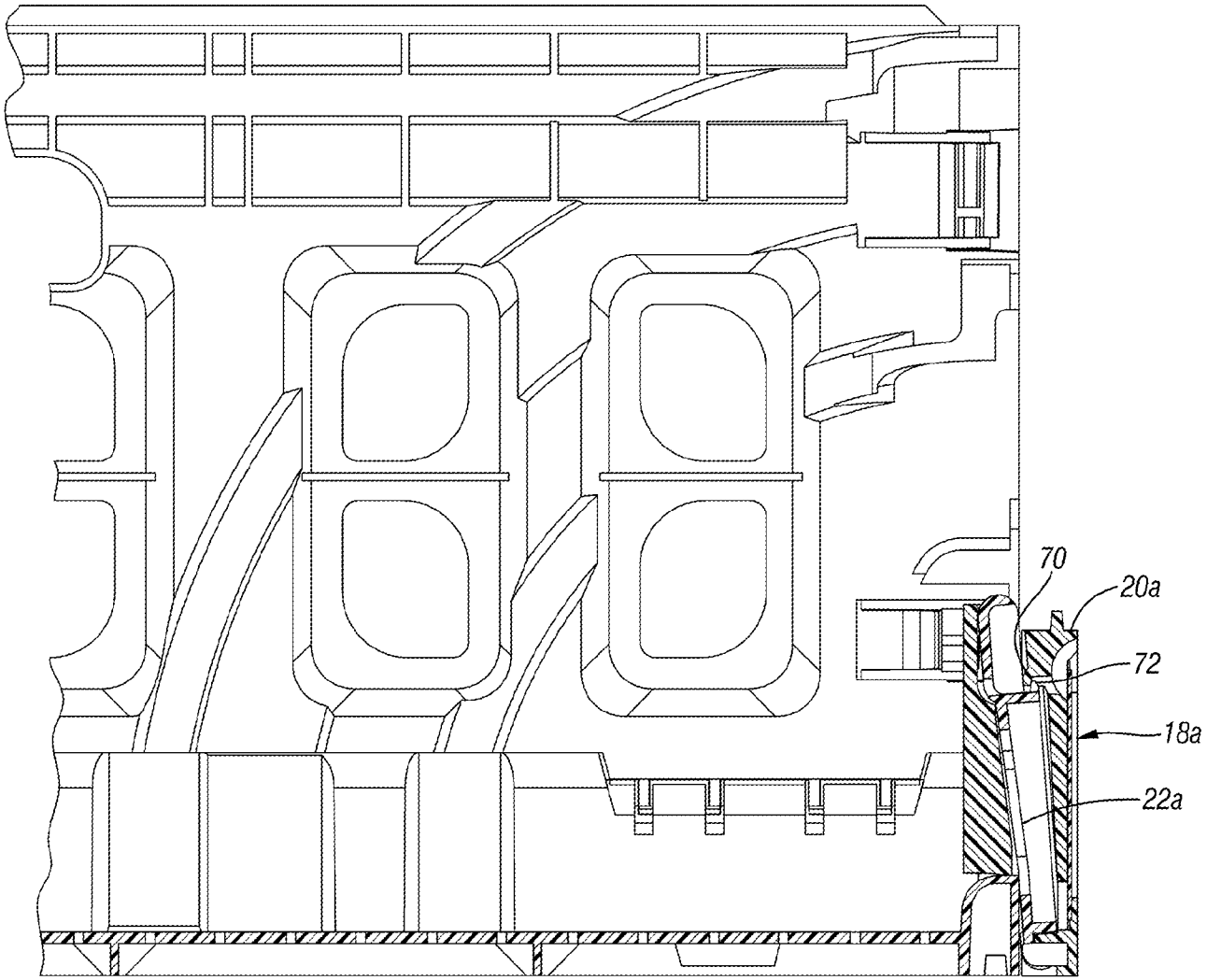
FIG. 12 is a view similar to that of FIG. 11 with an alternate front wall.

FIG. 12 is similar to FIG. 11 and illustrates an alternate front wall 18*a*, in which the upper section 20*a* includes a snap tab 70, which snap-fits to a snap tab 72 formed on the middle section 22*a* to retain the upper section 20*a* in the retracted position.

Figure 13:
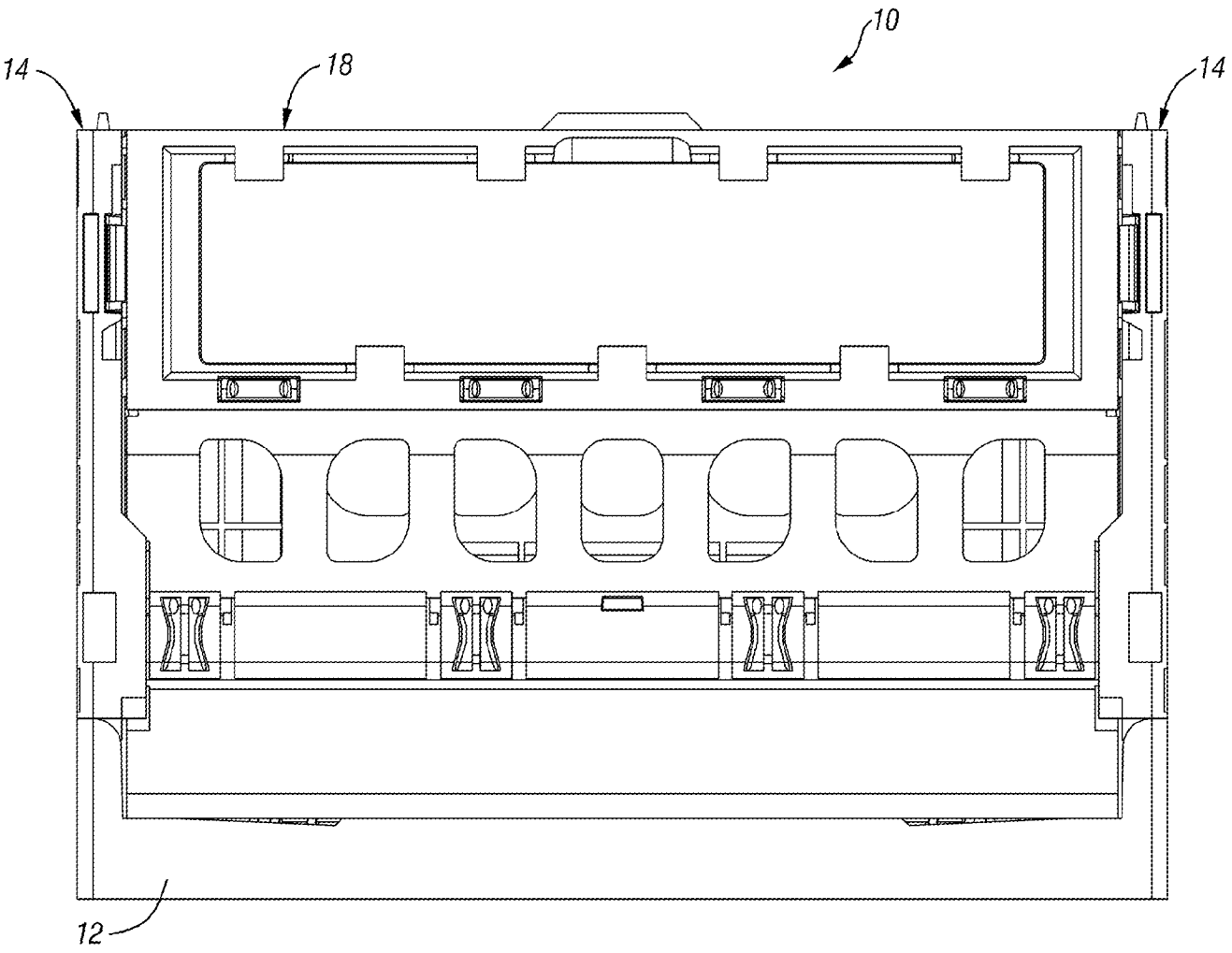
FIG. 13 is a front view of the crate of FIG. 1.
Figure 14:
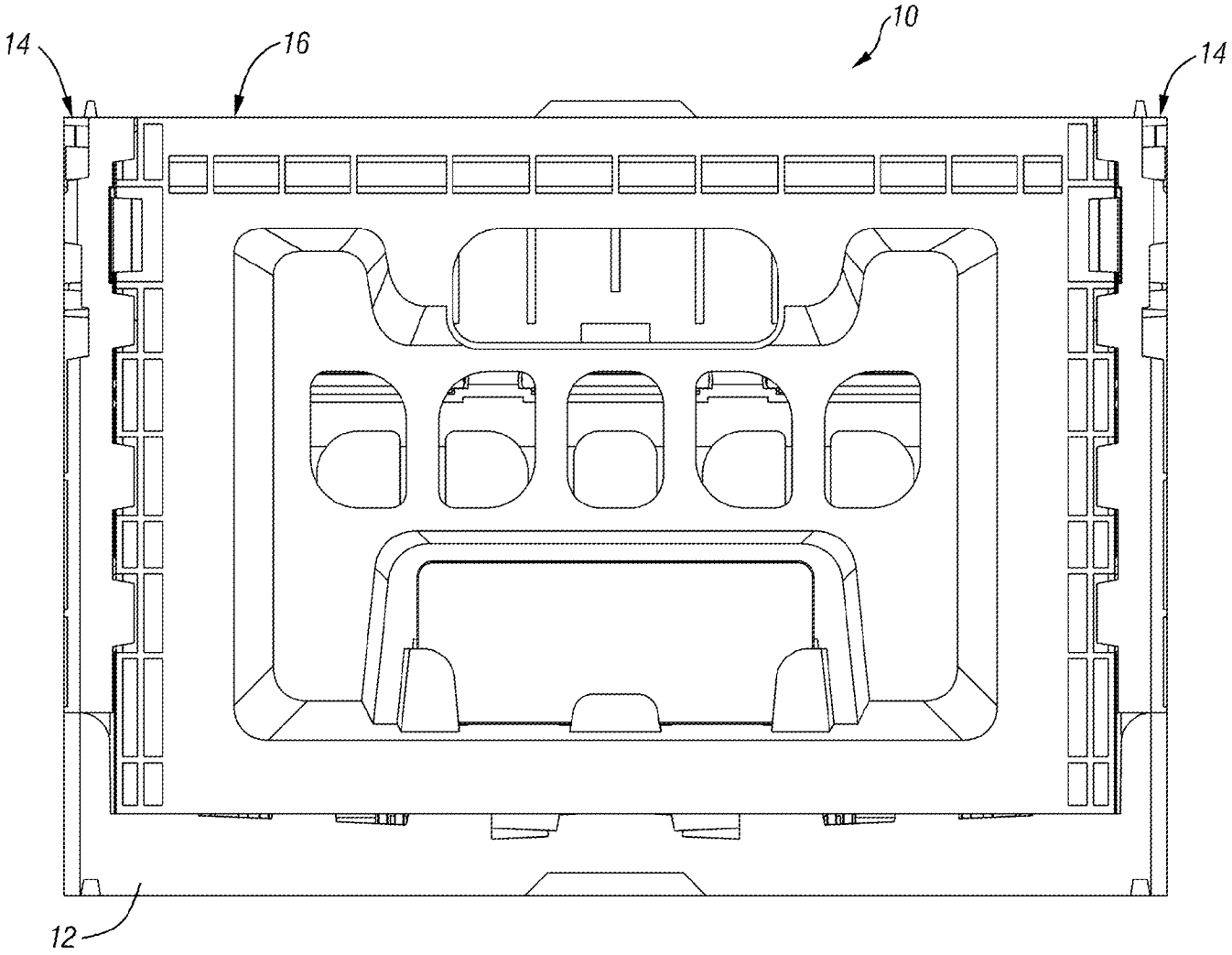
FIG. 14 is a rear view of the crate of FIG. 1.
Figure 15:
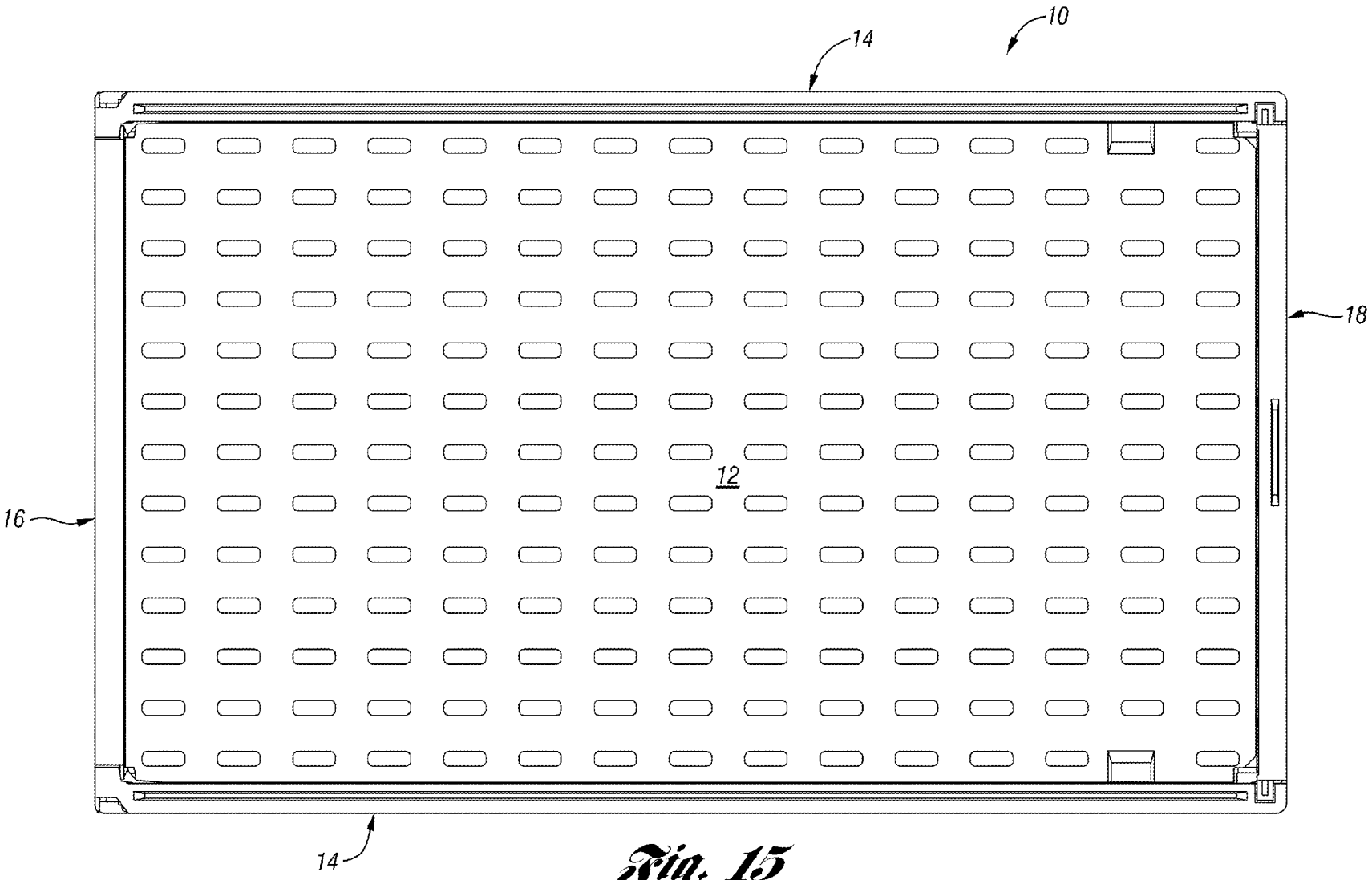
FIG. 15 is a top view of the crate of FIG. 1.
Figure 16:
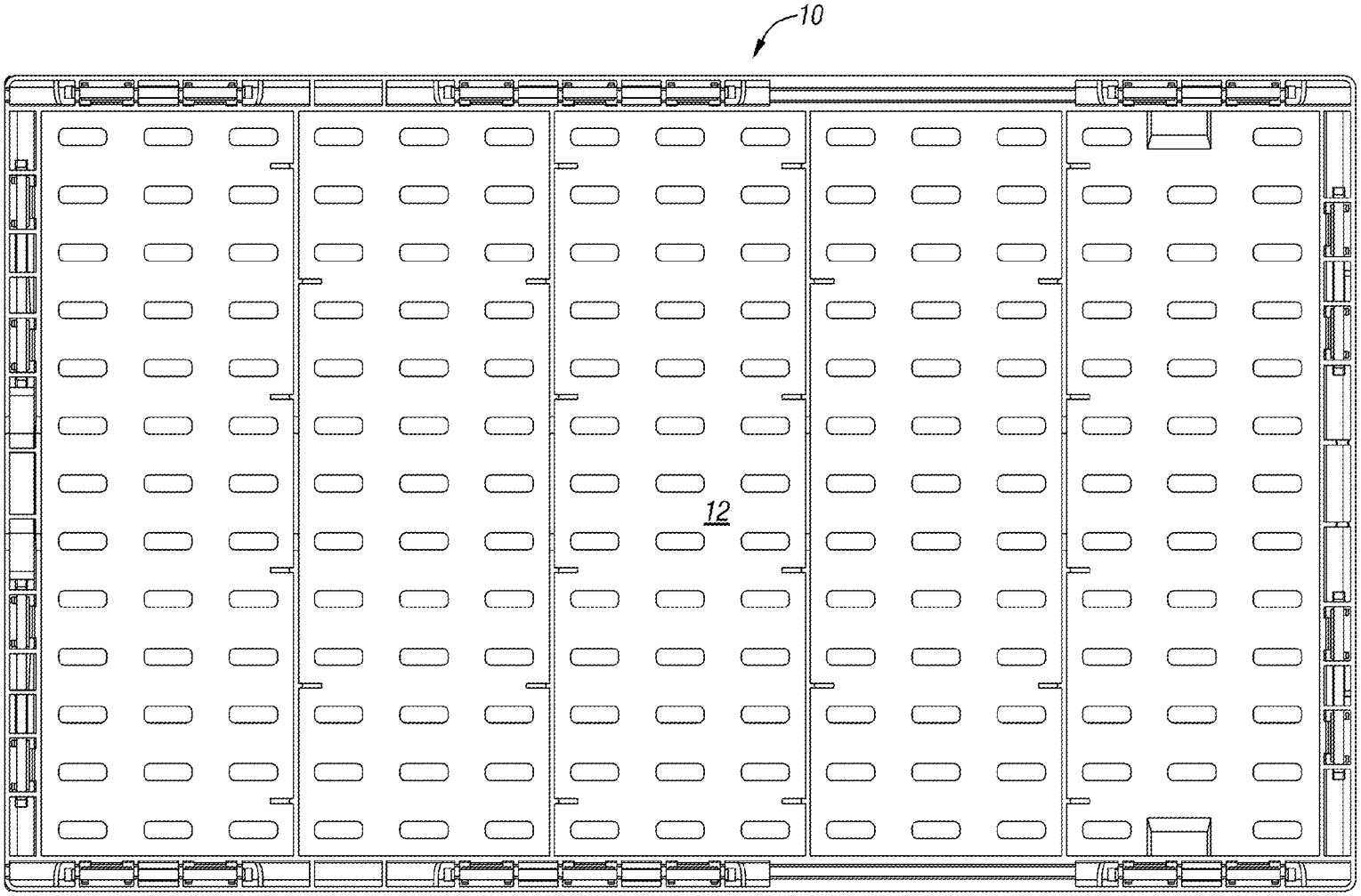
FIG. 16 is a bottom view of the crate of FIG. 1.

FIG. 13 is a front view of the crate 10. FIG. 14 is a rear view of the crate 10. FIG. 15 is a top view of the crate 10. FIG. 16 is a bottom view of the crate 10.

Figure 17:
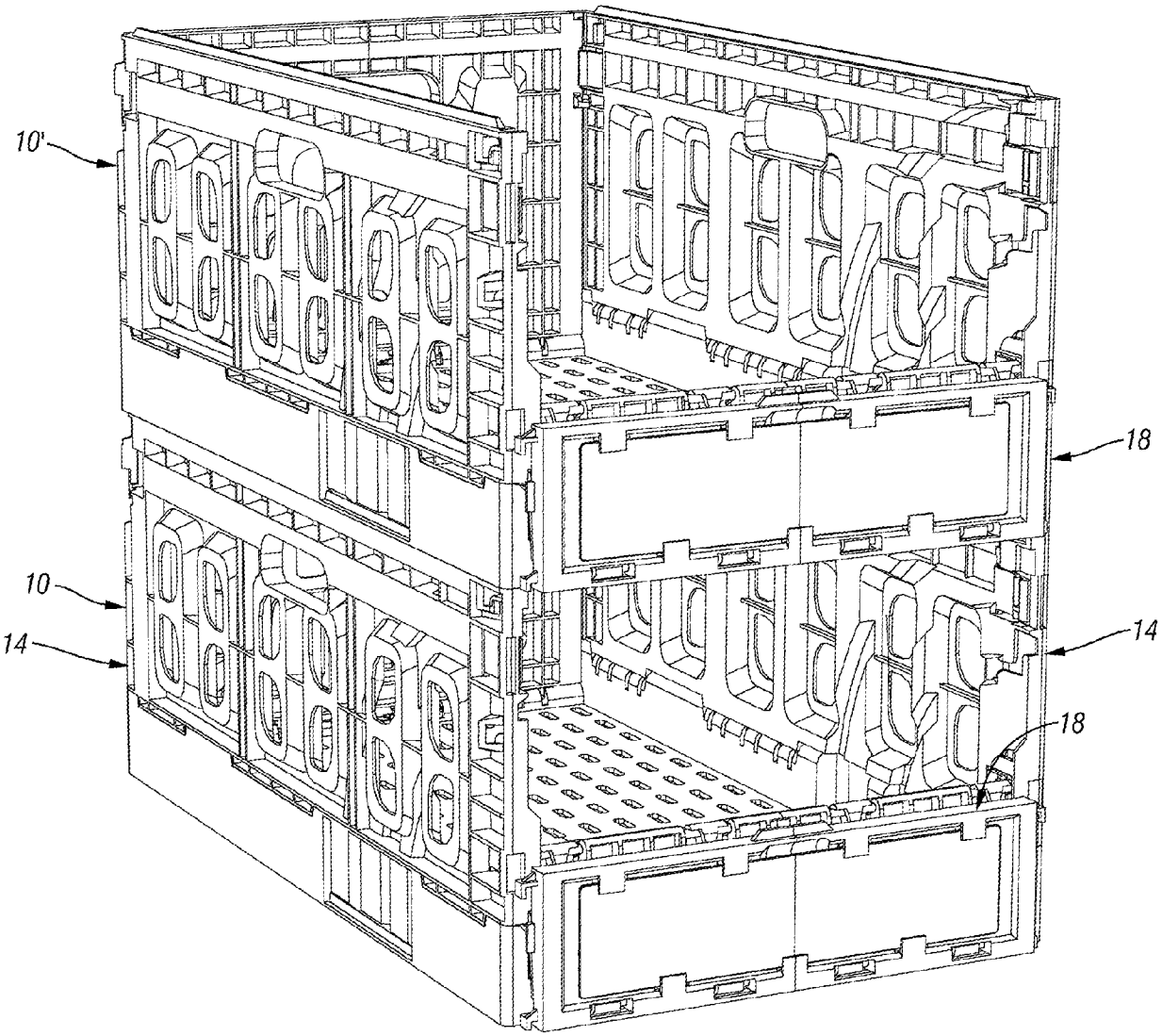
FIG. 17 is a perspective view of the crate of FIG. 1 with the front wall retracted and with a similar crate stacked thereon.

As shown in FIG. 17, with the front wall 18 in the retracted position, a similar crate 10' can be stacked on the crate 10. The retracted front wall 18 provides easy access to the interior of the crate 10 even with a similar crate 10' stacked thereon. The upper crate 10' has a front wall 18' that may similarly be retracted.

In use, egg cartons (or other items) would be shipped to a store in the crate 10 with the front wall 18 closed (FIG. 1). At the store, the front wall 18 would be collapsed (FIGS. 6-11) to provide access to the egg cartons in the interior of the crate 10 by customers or by store workers. When empty, the side walls 14 and rear wall 16 are collapsed onto the base 12 as shown in FIG. 5 so that the crates 10 occupy less volume and can be efficiently returned to be reused in shipping additional egg cartons (or other items).

Figure 18:
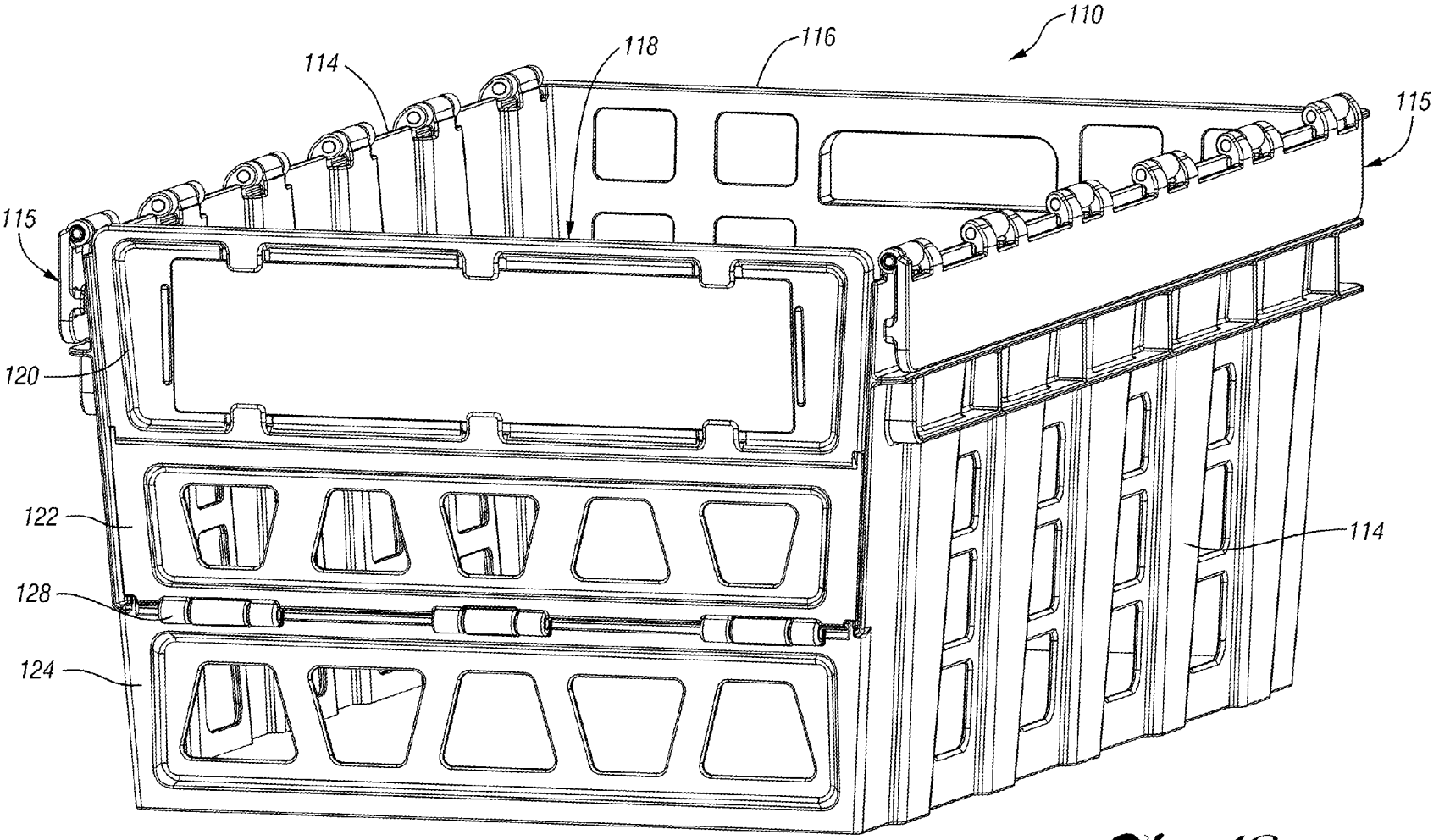
FIG. 18 is a front perspective view of a crate according to a second embodiment of the present invention.

FIG. 18 illustrates a crate 110 according to a second embodiment of the present invention. While the container of FIGS. 1-17 was a collapsible container, the container of FIGS. 18-21 is a nestable container. The crate 110 includes a base integrally molded with side walls 114 and rear wall 116. A retractable front wall 118 includes a plurality of sections 120, 122 and 124. The lower section 124 is also integrally molded with the base 112 and side walls 114. The upper section 120 is hingably connected to the middle section 122. The middle section 122 is hingably and slidably connected to the lower section 124 via hinge 128, which may be identical to hinge 28 of the first embodiment.

Figure 18A:
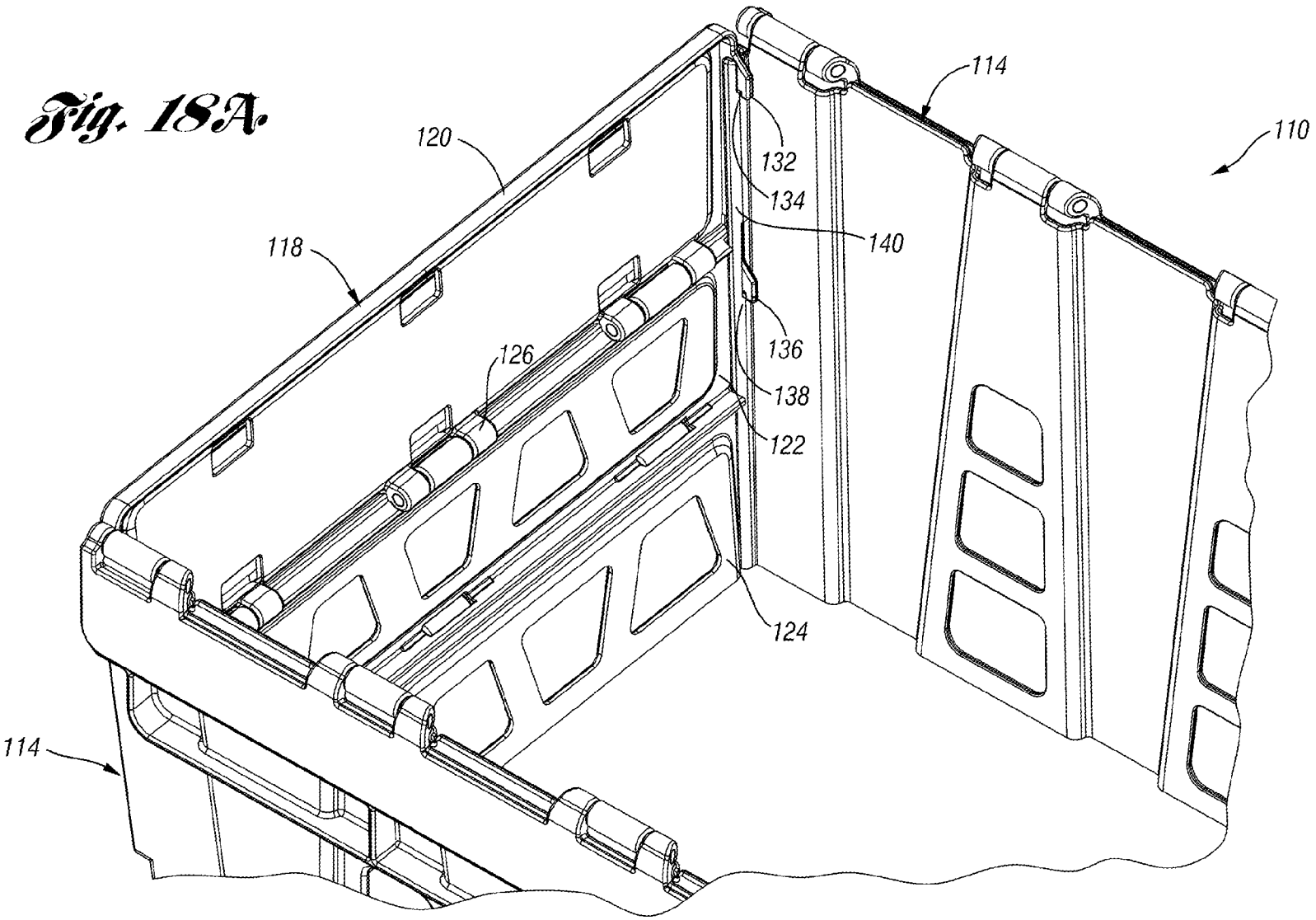
FIG. 18A is an interior perspective view of the front wall of the crate of FIG. 18.

FIG. 18A is an interior perspective view of the front wall of the crate 110 of FIG. 18. The upper section 120 is connected to adjacent side walls 114 by hooks 132 extending toward the interior of the crate 110 from the upper section 120 and received in hooks 134 formed in flanges 140 extending toward one another from the side walls 114 (only one flange 140 is visible in FIG. 18A, but the other side wall 114 would include a similar flange 140 with a hook 134). Additional hooks 136 extend toward the interior from the middle section 122 and are received in slots or hooks 138 formed in the flanges 140 of the side walls 114.

The crate 110 further includes support flaps 115 hingably connected to upper edges of the side walls 114. In FIG. 18, the support flaps 115 are shown in the retracted position.

Figure 19:
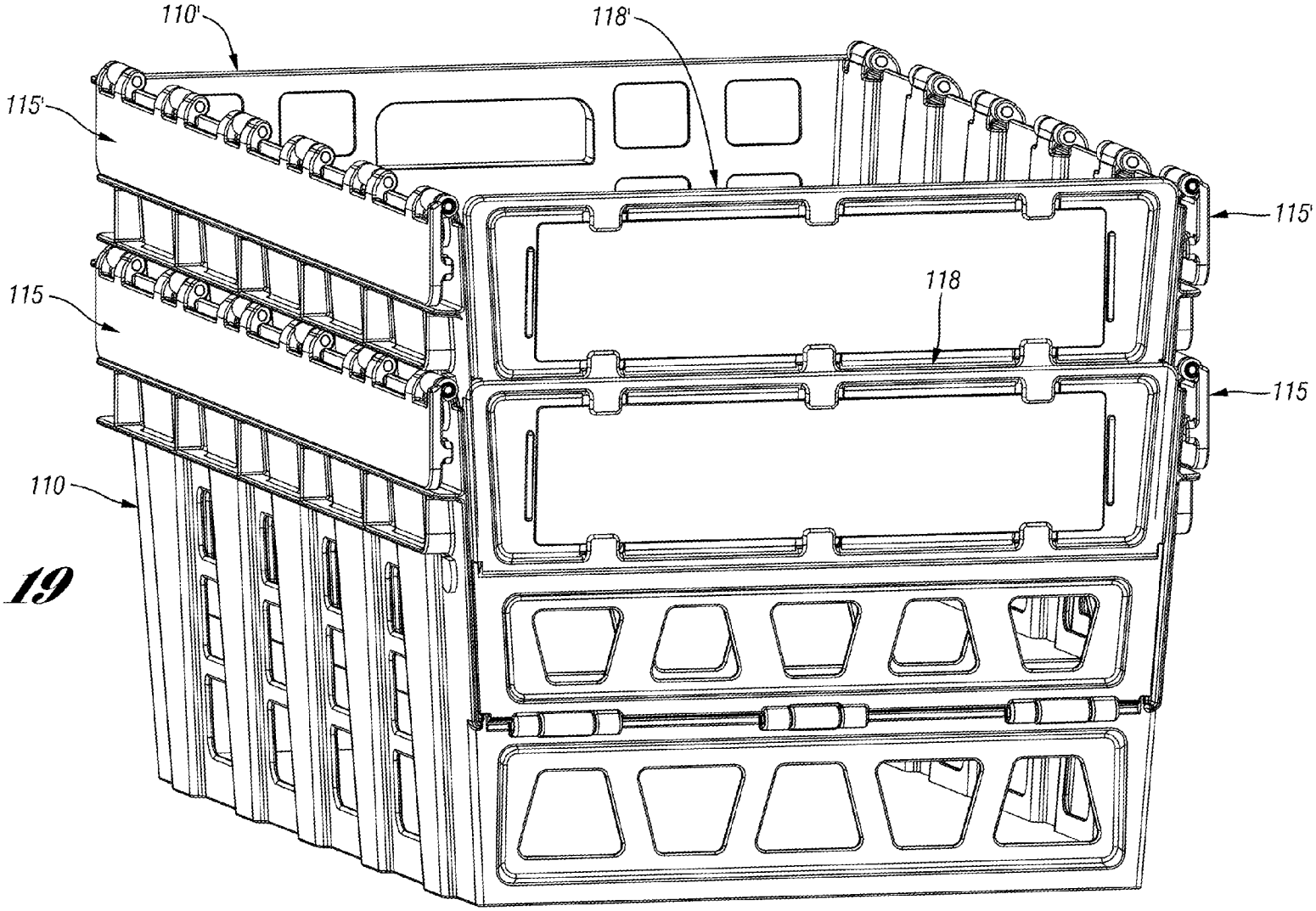
FIG. 19 shows the crate of FIG. 18 with a similar crate nested therein.

As shown in FIG. 19, the walls of the crate 110 are tapered such that a similar crate 110' can be substantially nested therein when the support flaps 115 are in the retracted position.

Figure 20:
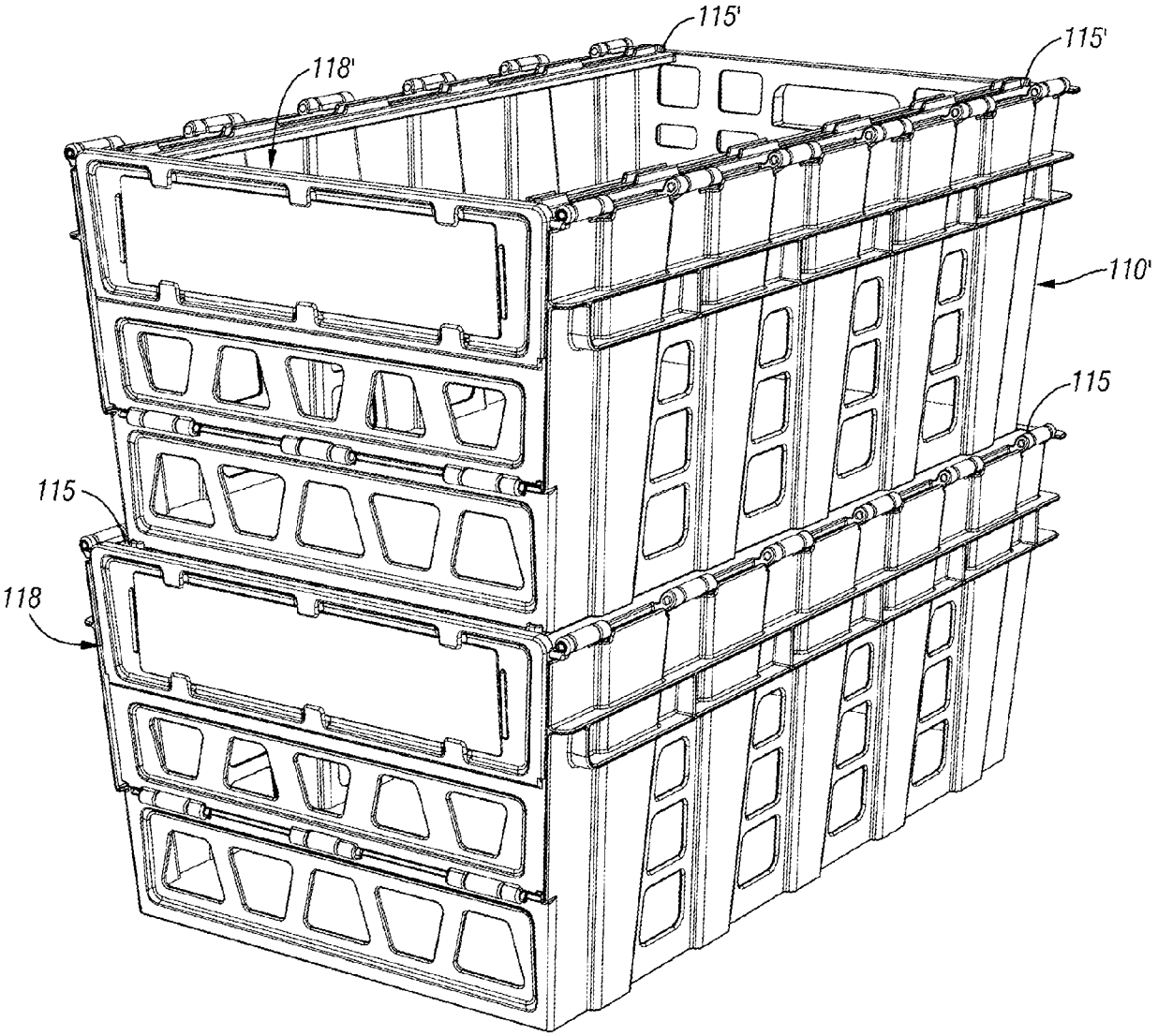
FIG. 20 shows the crate of FIG. 18 with a similar crate stacked thereon.

As shown in FIG. 20, the crate 110 can also support a similar crate 110' on the support flaps 115 when the support flaps 115 are pivoted to the inward, support position.

Figure 21A:
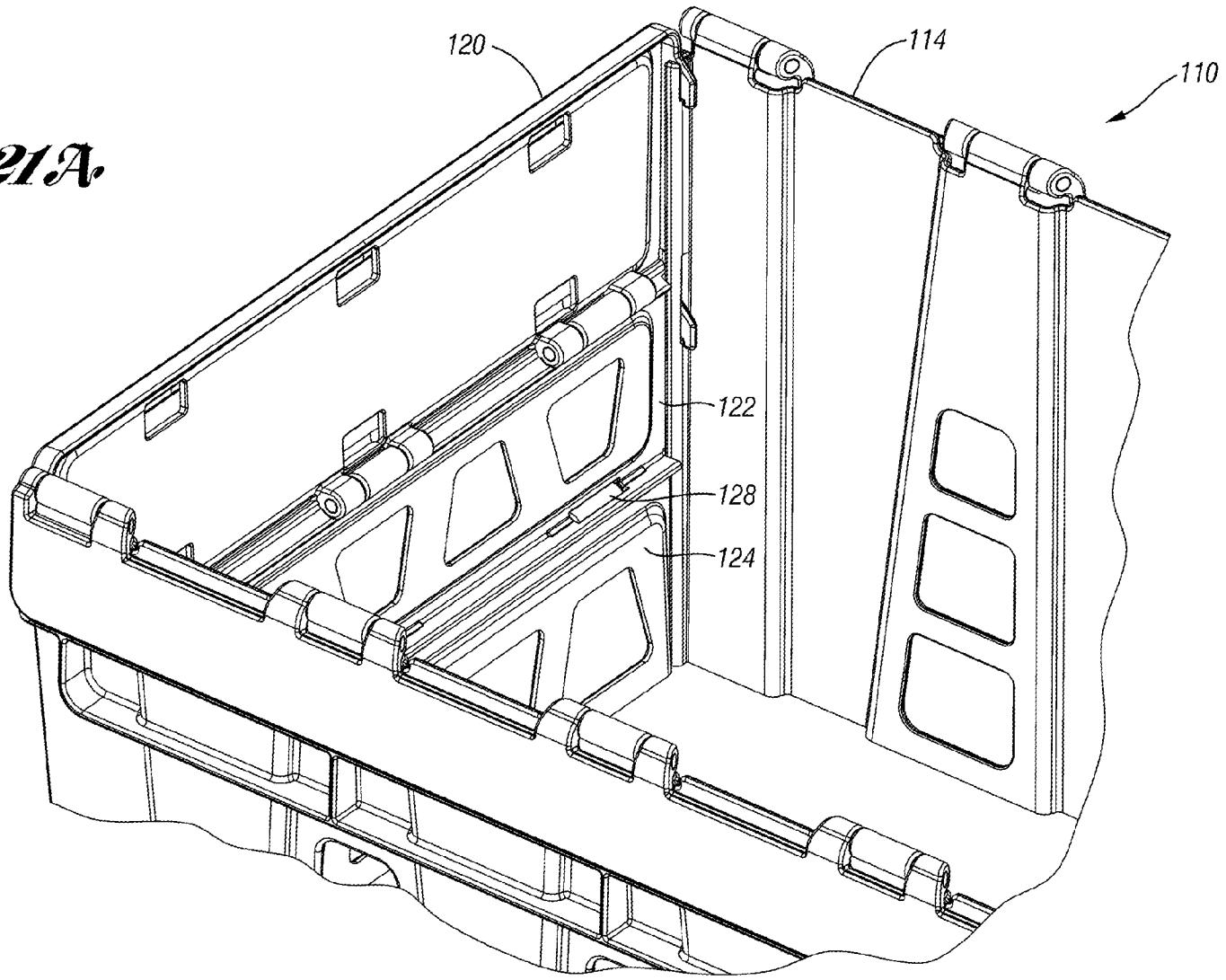
FIG. 21A shows a first step in retracting the front wall of the crate of FIG. 18.
Figure 21B:
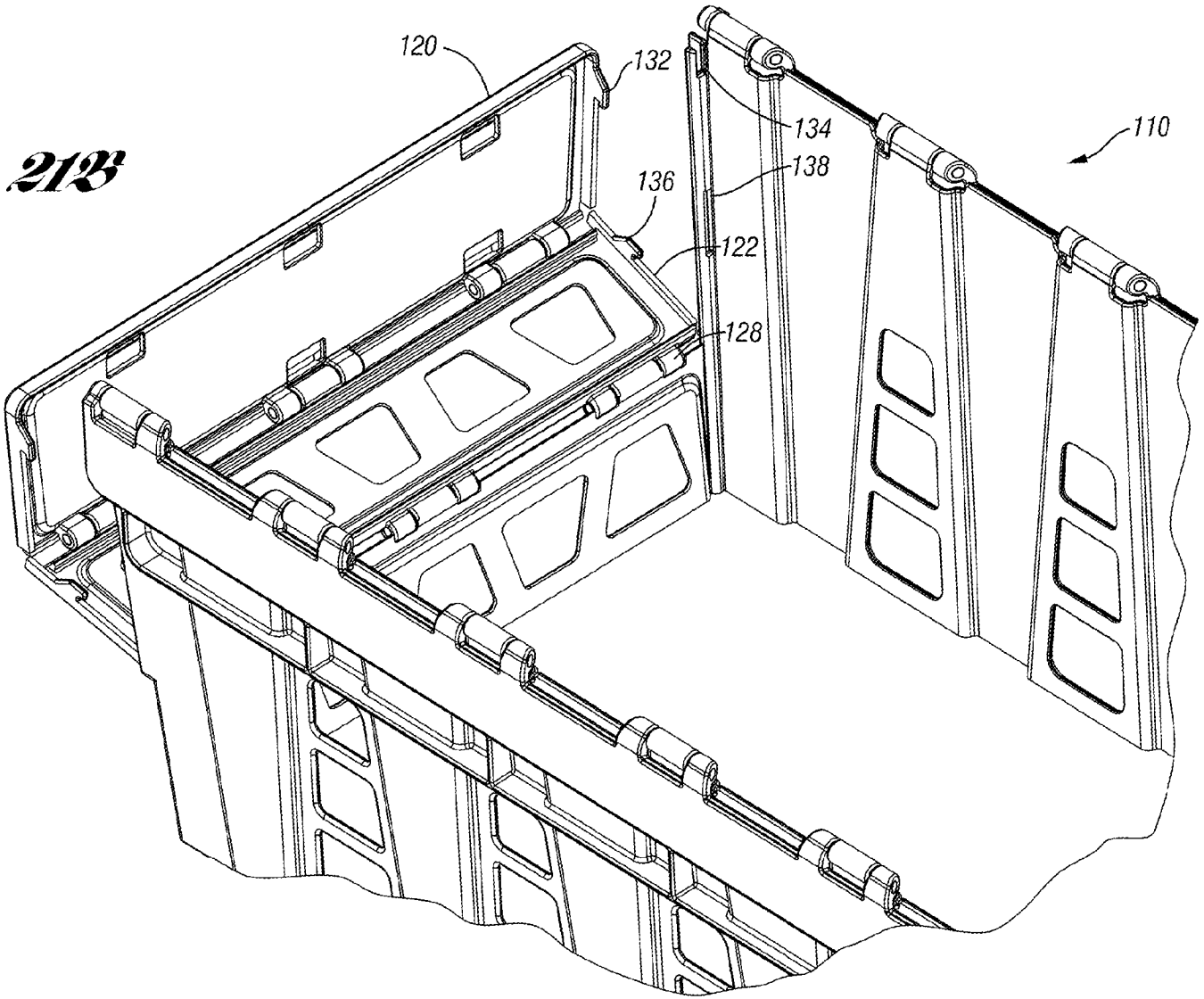
FIG. 21B shows a second step in retracting the front wall.
Figure 21C:
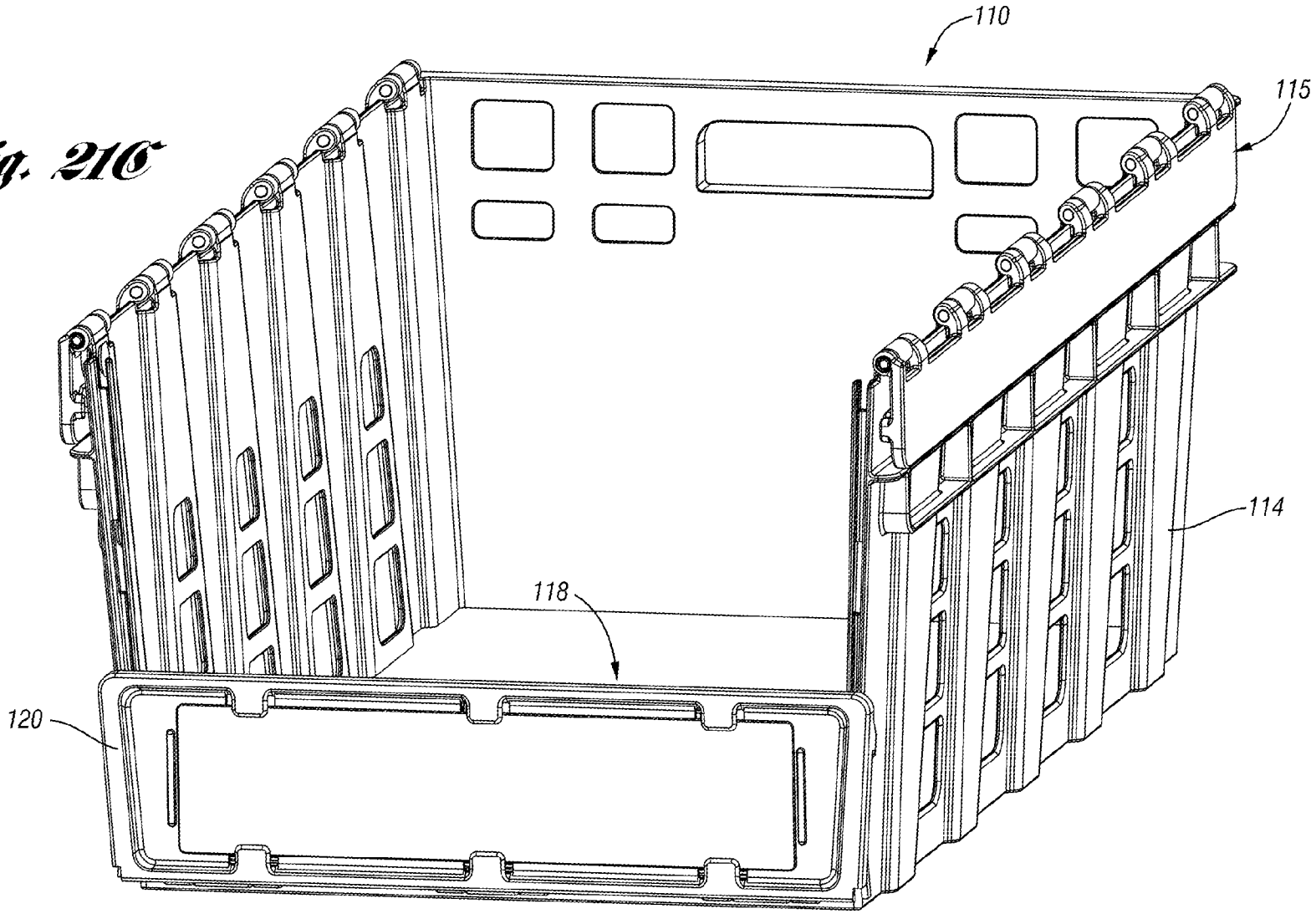
FIG. 21C shows the crate of FIG. 18 with the front wall retracted.
Figure 22:
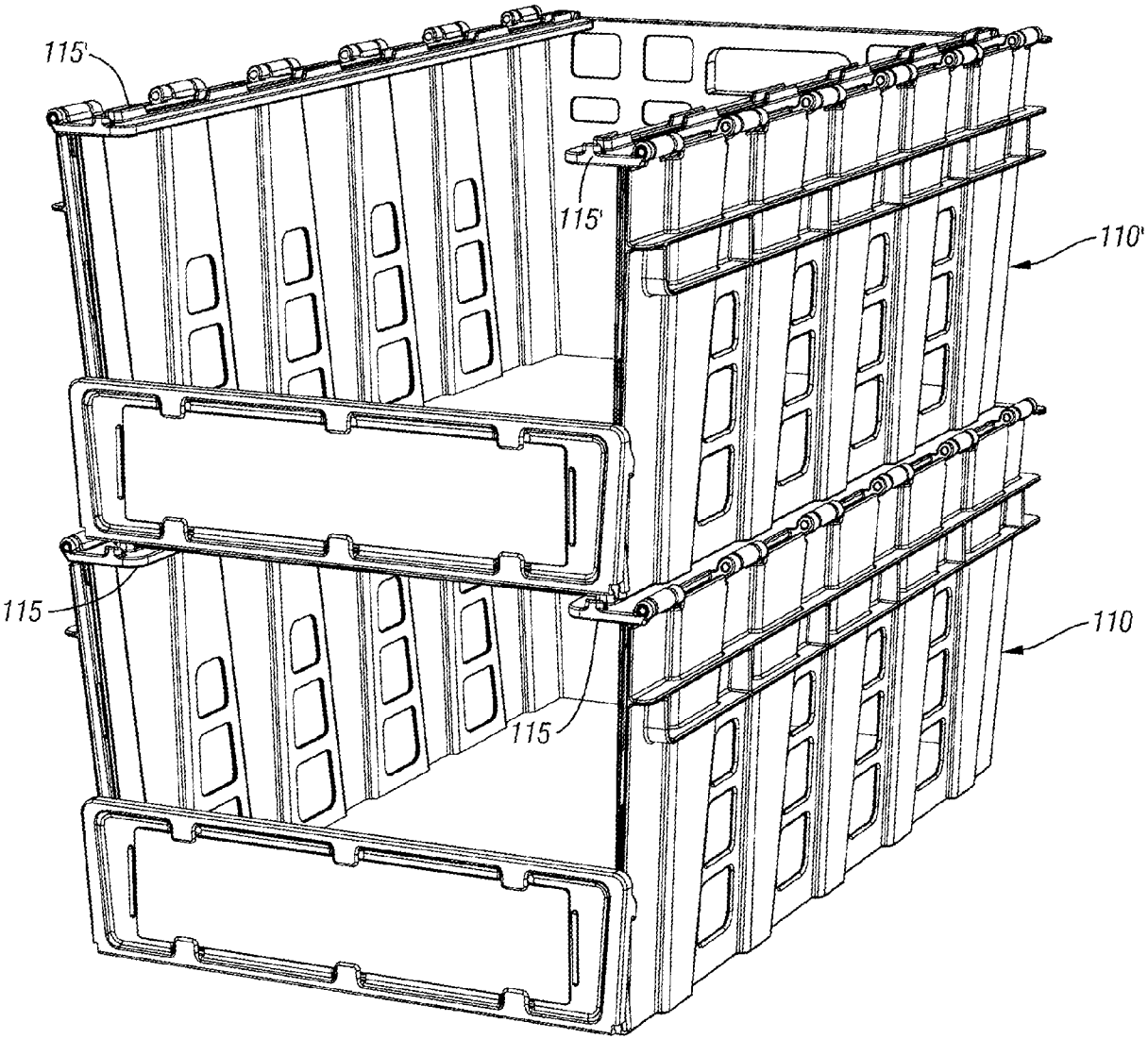
FIG. 22 shows the crate of FIG. 21C with a similar crate stacked thereon.

FIGS. 21A-C illustrate how the front wall 118 can be retracted in a manner substantially similar to that of the first embodiment. First, as shown in FIG. 21A, the upper section 120 and middle section 122 of the front wall 118 are lifted to remove the hooks 132, 136 from the hooks 134, 138 via sliding movement in the hinge 128. The upper section 120 and middle section 122 are then pivoted downwardly over the lower section 124 as shown in FIG. 21B to the position shown in FIG. 21C. In the retracted position shown in FIG. 21C, the interior of the crate can easily be accessed. It should be noted that the front wall 118 can be in the retracted position when a similar crate is stacked thereon, as shown in FIG. 22.

When the crate 110 is loaded with items (such as egg cartons), the support flaps 115 are flipped inward, where they can support a like crate 110' thereon (FIG. 20). In this manner, loaded crates 110, 110' are stacked and shipped to the store for sale. At the store, the front wall 118 can be collapsed as explained above to facilitate unloading by customers or employees. When empty, many empty crates 110, 110' can be nested together to substantially reduce storage and shipping volume.

Figure 23:
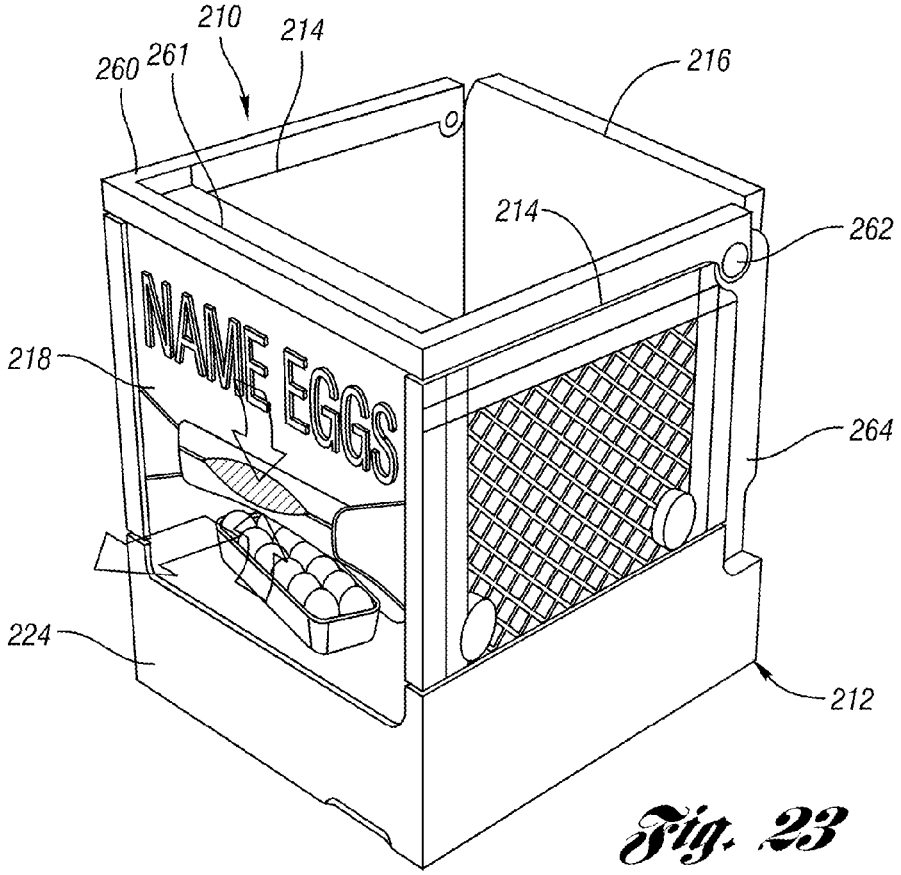
FIG. 23 is a perspective view of a crate according to a third embodiment.
Figure 24:
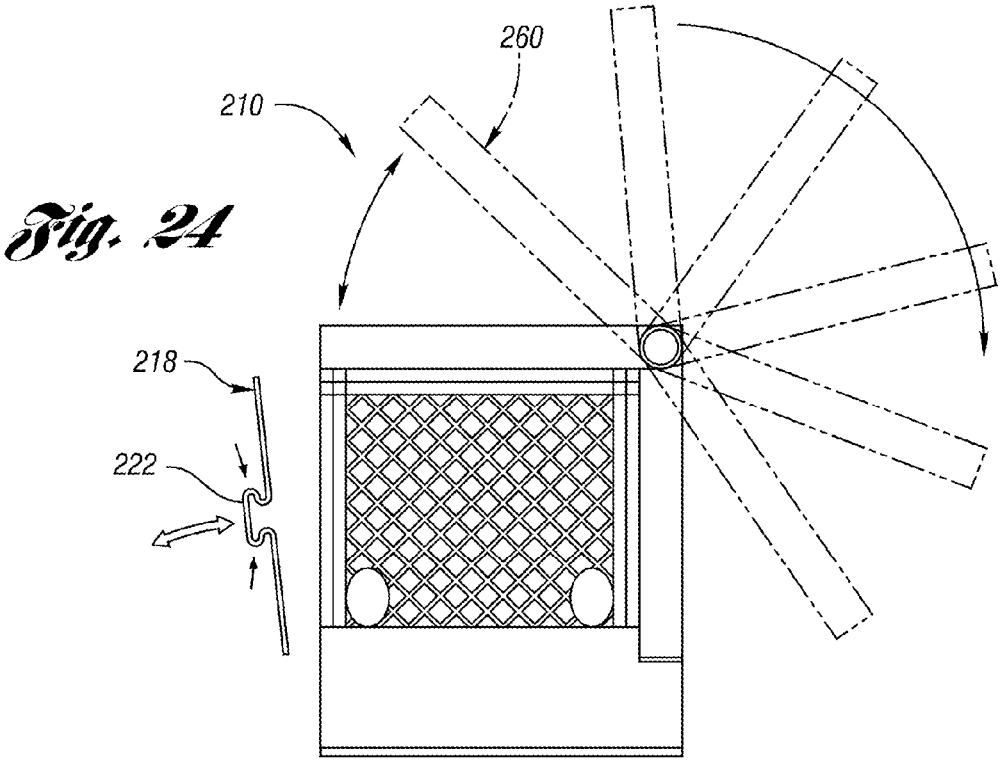
FIG. 24 is a side view of the crate of FIG. 23.

A crate 210 according to a third embodiment is shown in FIGS. 23-24. The crate 210 includes a base 212 having a pair of side walls 214 and a rear wall 216 extending upwardly therefrom. The side walls 214 and rear wall 216 may each be pivotably connected to a fixed lower portion integrally molded with the base 212.

A removable front wall 218 may be formed of cardboard, styrene or molded polymer. The front wall 218 includes an integrally formed handle portion 222, which when compressed, shortens the overall height of the front wall 218, thus permitting it to be removed from the crate 210.

An upper support 260 is connected by a hinge 262 at rear upper corners of the side walls 214. The upper support 260 is supported by the side walls 214 and extends across the upper edge of the front wall 218. A front bar 261 of the upper support 260 provides support for similar crates to be stacked thereon.

In use, the crate 210 is loaded with egg cartons (or other items) and stacked with other crates and shipped to a store. The front bar 261 of the upper support 260 provides support across the front of the crate 210 for the crate stacked thereon. At the store, if there are no additional crates stacked on the crate 210, the upper support 260 may be pivoted rearwardly on the hinge 262 into a recess 264 formed in the side walls 214 and rear wall 216.

The front wall 218 can be removed to provide access to the interior of the crate 210 independently of the position of the upper support 260. In this manner, items in the crate 210 can be merchandised from the crate 210 whether or not another crate is stacked thereon.

Figure 25:
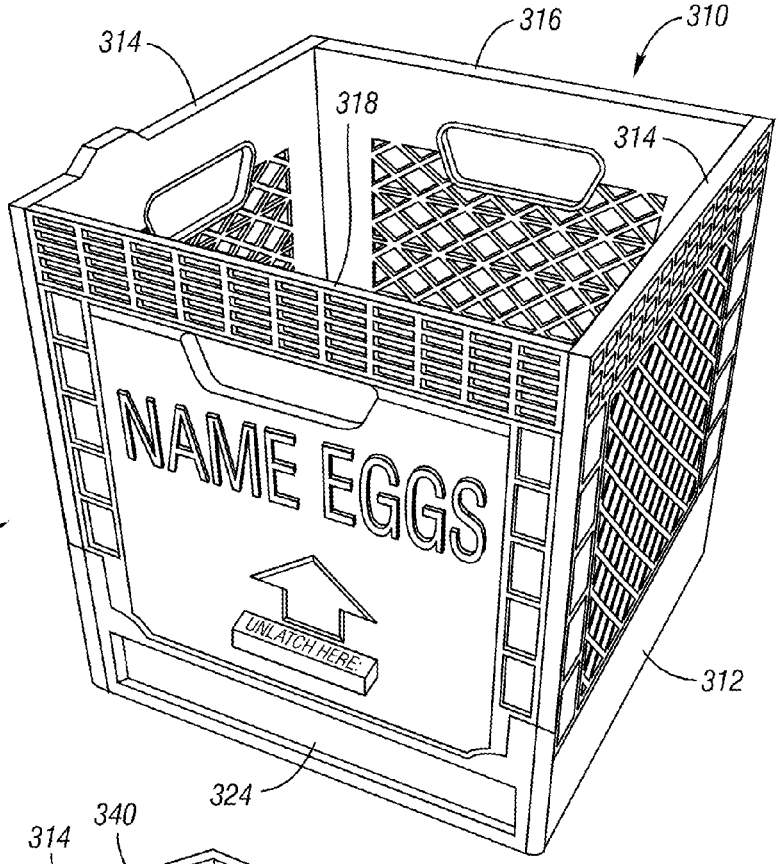
FIG. 25 is a perspective view of a crate according to a fourth embodiment.
Figure 26:
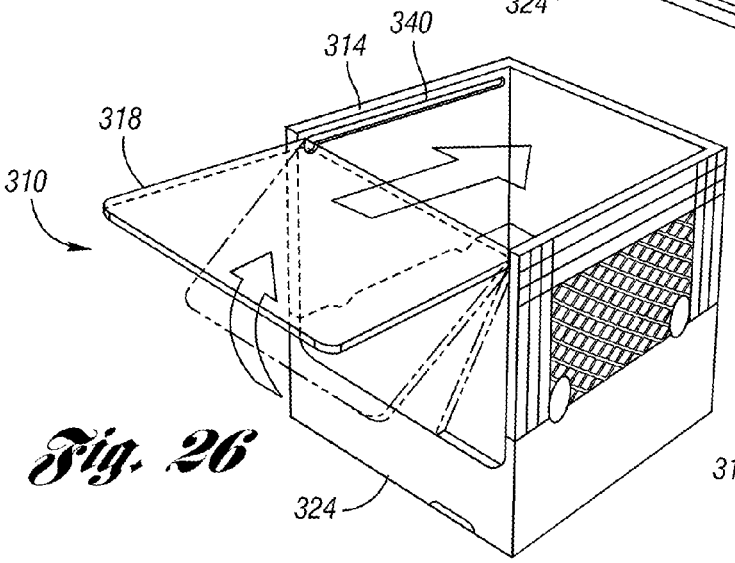
FIG. 26 illustrates the movement toward a retracted position of the front wall of crate of FIG. 25.
Figure 27:
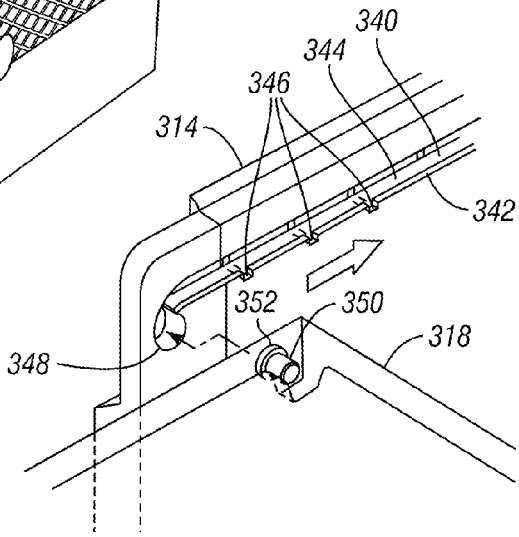
FIG. 27 is an enlarged view of the connection between the front wall and one of the side walls.

A crate 310 according to a fourth embodiment of the present invention is shown in FIGS. 25-26. The crate 310 includes a base 312 having a pair of side walls 314 and a rear wall 316 extending upwardly therefrom. The side walls 314 and rear wall 316 may each be each pivotably connected to a fixed lower portion integrally molded with the base 312.

The side walls 314 each include a track 340 on an interior upper edge. The track 340 may be an elongated recess as shown. A retractable front wall 318 is slidably mounted to the tracks 340 in the side walls 314. This is shown in more detail in FIG. 26. Each track 340 includes an elongated portion 342 having a lip 344 extending upwardly on an interior edge. The lip 344 includes a plurality of small openings 346 therethrough to assist in drainage when the crate 310 is washed. The track 340 further includes an enlarged portion 348 at a forward end thereof, into which a hinge pin 350 of the front wall 318 is received. The hinge pin 350 includes an enlarged portion 352 of increased diameter at an outer end. The enlarged portion 352 slides in the track 340 and is retained behind the lip 344.

In use, cartons of eggs (or other items) are shipped to a store in the crate 3 10. At the store, the lower end of the front wall 318 can be lifted as shown in FIG. 26, pivoting on the hinge pin 350 in the enlarged portion 348 of the track 340. The front wall 318 is then slid rearwardly, sliding the hinge pins 350 in the elongated portions 342 of the tracks 340. The interior of the crate 310 can then be accessed through the front of the crate 310 by customers or by store workers to remove the egg cartons. When empty, the front wall 318 can be removed and the side walls 314 and rear wall 316 can be collapsed onto the base 312 for more efficient return shipping for reuse.

It should be noted that the front wall 18, 118, 218, 318 is only designated "front" for convenience of reference, and that by itself, the term "front" does not require any specific wall (or walls) of the container to have these features. In the particular application of shipping egg cartons, it is expected that the retractable wall would be oriented toward the customers; however this invention is not limited to that application or to only the "front" wall being retractable. Unless otherwise required by the claims, the long walls could be retractable.

Although preferred embodiments have been disclosed, a worker of ordinary skill in this art would recognize that certain modifications would come within the scope of the claims. For that reason, the following claims should be studied to determine their true scope and content.

What is claimed is:

1. A container comprising:

a base; and a plurality of walls extending upward from the base, the plurality of walls including a first wall, a second wall, and opposing side walls extending generally perpendicularly to the first wall and the second wall, the first wall including a plurality of sections retractable together to a retracted upright position to provide an opening into the container, at least two of the plurality of sections engage the opposing side walls in the upright position.

2. The container of claim 1 wherein the plurality of sections are movable to an extended upright position at least partially closing the opening into the container.

3. The container of claim 2 wherein the plurality of sections are pivotable relative to one another.

4. The container of claim 3 wherein two of the plurality of sections are pivotable and slidable relative to one another.

5. The container of claim 4 wherein the two of the plurality of sections are pivotably locked relative to one another when in a first relative position, and are pivotable relative to one another when slid from the first relative position to a second relative position, wherein one of the two sections is displaced from the other of the two sections in a direction generally parallel to the two sections when the two sections are in the second relative position relative to the first relative position.

6. The container of claim 4 wherein the two of the plurality of sections are pivotably and slidably connected by a hinge having an axis, wherein the two sections are pivotably locked relative to one another when in a first relative position, and are pivotable relative to one another when slid away from one another in a direction perpendicular to the axis from the first relative position to a second relative position.

7. The container of claim 1 wherein at least one of the plurality of sections includes a connector for connecting to one of the side walls.

8. The container of claim 1 wherein the plurality of sections comprise three sections.

9. The container of claim 1 wherein the container is comprised of molded components.

10. The container of claim 1 wherein the base includes an integral upstanding portion, and the first wall is connected to the integral upstanding portion.

11. A container comprising:

a base; and a plurality of side walls extending upward from the base, the plurality of side walls including a first wall, the first wall including a plurality of sections retractable together to a retracted upright position to provide an opening into the container, wherein each of the plurality of walls, other than the first wall, are integrally molded with the base and with at least one adjacent wall.

12. The container of claim 11 wherein the plurality of sections comprise three sections.

13. The container of claim 11 wherein the container is comprised of molded components.

14. The container of claim 11 wherein the base includes an integral upstanding portion, and the first wall is connected to the integral upstanding portion.

* * * * *